US007047889B2

(12) United States Patent
Forbes

(10) Patent No.: US 7,047,889 B2
(45) Date of Patent: May 23, 2006

(54) RAIL CAR WITH CANTILEVERED ARTICULATION

(75) Inventor: James W. Forbes, Campbellville (CA)

(73) Assignee: National Steel Car Limited (CA)

( * ) Notice: Subject to any disclaimer, the term of this patent is extended or adjusted under 35 U.S.C. 154(b) by 293 days.

(21) Appl. No.: 10/081,120

(22) Filed: Feb. 22, 2002

(65) Prior Publication Data

US 2002/0178966 A1 Dec. 5, 2002

Related U.S. Application Data

(63) Continuation of application No. 09/614,815, filed on Jul. 12, 2000, now abandoned.

(51) Int. Cl.
*B60P 7/08* (2006.01)

(52) U.S. Cl. ..... 105/4.1; 105/355; 105/378; 410/24; 410/25; 273/75 R

(58) Field of Classification Search ..... 105/165, 105/167, 157.2, 215.1, 215.2, 3, 4.1, 4.3, 105/355, 378, 458; 213/85, 78, 75 R, 77; 410/2, 3, 4, 26, 24
See application file for complete search history.

(56) References Cited

U.S. PATENT DOCUMENTS

| | | | | |
|---|---|---|---|---|
| 1,535,799 | A | | 4/1925 | Adams |
| 1,608,665 | A | | 4/1926 | Pehrson |
| 1,713,898 | A | | 5/1929 | Gilpin |
| 1,735,617 | A | | 11/1929 | Nystrom |
| 1,754,111 | A | | 4/1930 | Latshaw |
| 2,132,002 | A | | 10/1938 | Dean |
| 2,155,615 | A | | 4/1939 | Rice |
| 2,517,811 | A | | 8/1950 | Torburn |
| 2,580,326 | A | | 12/1951 | Stevens |
| 2,865,306 | A | | 12/1958 | Brock et al. |
| 3,173,382 | A | | 3/1965 | Ryan |
| 3,290,058 | A | | 12/1966 | Ellerd |
| 3,323,472 | A | | 6/1967 | Boone et al. |
| 3,371,622 | A | * | 3/1968 | Lich ..... 105/4.3 |
| 3,502,040 | A | * | 3/1970 | Reilly ..... 104/247 |
| 3,678,863 | A | | 7/1972 | Pringle |
| 3,871,276 | A | | 3/1975 | Allen |
| 3,995,563 | A | | 12/1976 | Blunden |
| 4,089,538 | A | | 5/1978 | Eastridge |
| 4,128,062 | A | | 12/1978 | Roberts |
| 4,191,107 | A | * | 3/1980 | Ferris et al. ..... 105/4.1 |
| 4,233,909 | A | | 11/1980 | Adams |
| 4,336,758 | A | | 6/1982 | Radwill |
| 4,421,339 | A | | 12/1983 | Hagin |
| 4,437,410 | A | | 3/1984 | Stoller, Sr. et al. |

(Continued)

FOREIGN PATENT DOCUMENTS

| | | |
|---|---|---|
| AT | 245610 | 3/1966 |

(Continued)

*Primary Examiner*—Frantz F. Jules
(74) *Attorney, Agent, or Firm*—Hahn Loeser & Parks LLP; Michael H. Minns

(57) ABSTRACT

An articulated rail car has a plurality of rail car units joined together at articulation connections, and carried upon a number of rail car trucks that is equal to the number of rail car units plus one. At least one of the articulated connectors is located at an offset distance from the nearest rail car truck, such that the adjacent rail car has an overhang, or cantilever, between the center of the truck and the pivot center of the articulation. The truck is a two axle, four-wheel freely pivoting truck.

60 Claims, 19 Drawing Sheets

U.S. PATENT DOCUMENTS

| | | | | |
|---|---|---|---|---|
| 4,503,779 | A | | 3/1985 | Chadwick |
| 4,615,275 | A | | 10/1986 | Ishizuka |
| 4,671,714 | A | | 6/1987 | Bennett |
| 4,721,426 | A | | 1/1988 | Bell et al. |
| 4,751,882 | A | | 6/1988 | Wheatley et al. |
| 4,826,259 | A | * | 5/1989 | Biegel ..... 303/22.2 |
| 4,924,780 | A | | 5/1990 | Hart |
| 4,929,132 | A | | 5/1990 | Yeates et al. |
| 4,942,824 | A | | 7/1990 | Cros |
| 4,947,760 | A | | 8/1990 | Dawson et al. |
| 5,010,614 | A | | 4/1991 | Braemert et al. |
| 5,046,582 | A | | 9/1991 | Albrecht |
| 5,131,548 | A | * | 7/1992 | Chi ..... 213/64 |
| 5,152,228 | A | | 10/1992 | Donkin |
| 5,174,211 | A | | 12/1992 | Snead |
| 5,271,335 | A | | 12/1993 | Bogenschutz |
| 5,271,511 | A | | 12/1993 | Daugherty, Jr. et al. |
| 5,320,046 | A | | 6/1994 | Hesch |
| 5,343,812 | A | | 9/1994 | Ishida |
| 5,392,717 | A | | 2/1995 | Hesch et al. |
| 5,398,619 | A | * | 3/1995 | Buccos ..... 105/157.2 |
| 5,511,491 | A | | 4/1996 | Hesch et al. |
| 5,515,792 | A | | 5/1996 | Bullock et al. |
| 5,596,936 | A | | 1/1997 | Bullock et al. |
| 5,601,033 | A | | 2/1997 | Ehrlich et al. |
| 5,622,115 | A | | 4/1997 | Ehrlich et al. |
| 5,657,698 | A | | 8/1997 | Black, Jr. et al. |
| 5,685,228 | A | | 11/1997 | Ehrlich et al. |
| 5,690,033 | A | | 11/1997 | Andre |
| 5,730,578 | A | | 3/1998 | Smidler |
| 5,743,192 | A | * | 4/1998 | Saxton et al. ..... 105/355 |
| 5,765,486 | A | | 6/1998 | Black, Jr. et al. |
| 5,782,187 | A | | 7/1998 | Black et al. |
| 5,794,537 | A | | 8/1998 | Zaerr et al. |
| 5,832,836 | A | | 11/1998 | Ehrlich et al. |
| 5,845,584 | A | | 12/1998 | Bullock et al. |
| 6,276,282 | B1 | * | 8/2001 | Schunke ..... 105/4.1 |

FOREIGN PATENT DOCUMENTS

| | | | |
|---|---|---|---|
| CH | 329987 | | 5/1958 |
| CH | 371475 | | 10/1963 |
| DE | 473036 | | 2/1929 |
| DE | 664933 | | 8/1938 |
| DE | 688777 | | 2/1940 |
| DE | 1 180 392 | | 10/1964 |
| DE | 2318369 | | 10/1974 |
| EP | 0 264 731 | | 4/1988 |
| EP | 347334 | | 4/1989 |
| EP | 494323 | A | 4/1992 |
| GE | 688777 | A | 4/1940 |
| IT | 324559 | | 2/1935 |
| JP | 58-39558 | | 3/1983 |
| JP | 63-279966 | | 11/1988 |

* cited by examiner

Rail Car
℄ Truck
℄ Transverse
℄ Pivot
TOR
20
22
24
26
28
30
32
34
36
38
40
41
42
44
45
46
47
48
49
61
63
65
67
D1
D2
D3
D4

RAIL CAR WITH CANTILEVERED ARTICULATION

This application is a continuation of application Ser. No. 09/614,815 filed on Jul. 12, 2000 Abandoned.

FIELD OF THE INVENTION

This invention relates generally to articulated rail road cars.

BACKGROUND OF THE INVENTION

The dimensions of rail road cars are constrained by a number of geometric considerations. First, on tangent track (that is, straight track) a rail road car can not be too wide, otherwise it may foul the sides of bridges, tunnels, roadside fittings such as switches or signals, or other cars of the same size passing on an adjacent track. Similarly, rail cars cannot be taller than the minimum regulated heights of the lowest bridges or tunnels on the tracks along which it is to travel. Third, the weight a car can carry is limited by the capacity of the tracks, rails and road bed over which it is to travel.

With reference to FIGS. 1*a*, 1*b*, 1*d* and 1*e*, on curved track, the relationship between length and width is important. Traditionally, single unit rail road cars A20 have had a car body supported by a rail car truck A22, A24 at either end. The mounting to a standard two axle, four wheel truck is at a pivot at the truck center, A26. The cars are connected at a releasable coupler A28 in the commonly known manner. When such a car passes through a curve trucks A22, A24 follow the arc indicated by the track centerline, $S_1$, while the car body centerline between the truck centers forms a chord $\kappa$ of the arc. Chord $\kappa$ subtends an angle $\alpha_1$ of arc $S_1$. This is shown, with exaggerated proportions, in FIG. 1*a*. The track center line radius is indicated as $R_1$. At midspan between the trucks, the inside edge of the car follows a circular arc having a radius of curvature indicated as the limiting inside minimum radius $R_2$. Car A20 is shown as having overhanging end portions A30 and A32 that extend longitudinally outboard of the respective truck centers. As car A20 passes through a curve the extreme outside corners of end portions A30 and A32 will follow along an outer radius, namely the limiting minimum outside radius indicated as $R_3$.

For any curve, the longitudinal center line of the car, CL, at mid-span between the trucks will lie some distance, $\delta$, inward from the center of the track, as indicated by $\delta_1$. This distance $\delta$ depends on the radius of curvature, $R_1$ of the tracks, and the distance between truck centers, $L_1$. As shown in FIG. 1*a*, for a given dimension $L_1$, $\delta$ increases as the radius of curvature decreases, as indicated by $R_4$. Alternatively, for a fixed track radius $R_1$, as the truck center distance $L_1$ increases, $\delta$ also increases. The left hand example of FIG. 1*a* demonstrates this. For a track having a radius of curvature $R_4$, the arc is identified as $S_2$. Placing two of rail road cars A20 on this track, the chord length remains $\kappa$ but the subtended angle, $\alpha_2$, is larger than $\alpha_1$, and the distances between the inner and outer clearance radii, $R_5$ and $R_6$, is greater than between $R_2$ and $R_3$, with a consequent increase in $\delta$ form $\delta_1$ to $\delta_2$.

In North American service, the relationship of rail road car width and length, and the corresponding necessary reductions in width required as truck center distance increases are set out by the American Association of Railroads (AAR) in various AAR standards. Cars to be used in interchangeable service are required to conform to the AAR standards. For all cars, including AAR plate 'C' cars, the limiting centerline track radius, $R_1$, is a standard minimum dimension of 5300.375 inches. For plate 'C' cars, the limiting minimum inside radius, $R_2$, is determined on the basis of a car ("the base car") having a truck center spacing of 46'-3" (555 inches), and a maximum car width of 10'-8" (128 inches). For this standard car, $\delta_1$ is roughly 7.25 inches, so $R_2$ is roughly 5229.12 inches For plate 'C' cars the limiting minimum outside radius, $R_3$, is defined as being greater than $R_1$ by the same amount as $R_2$ is less than $R_1$. Thus, adding the 7.25 inch offset, plus half of the car width, namely 64 inches, gives an $R_3$ of 5371.63 inches.

If car A20 is not to foul adjacent cars or adjacent structures while passing through curves, as the truck center length increases beyond 46'-3", the width of the car must decrease correspondingly so the inside of the car at mid-span between the trucks of the car does not cut to the inside of $R_2$. The allowable width of a car for a given truck center distance can be calculated from this datum case. A different standard applies for auto-rack rail road cars, but the principles are the same. In AAR specification M-950-A-99, the maximum width of a bi-level auto-rack car having a length of 90' over the strikers is given as 119" at mid span, and 121" at the strikers. Typically such an auto-rack has truck centers on either 64' or 66' spacing. The limiting minimum inside radius, $R_2$, for this car is 5226.06 inches and the limiting minimum outside radius, $R_3$, is 5373.27". The outside extreme corners A30, A32 must stay within $R_3$. In some cases, for long overhangs, the ends of the car must be narrowed.

Similarly, some types of inter-modal well cars are used for carrying containers, or for carrying highway trailers or a combination of the two. The well must be wide enough to accommodate either the highway trailers or the containers, as may be required. Center beam cars, such as are commonly used for carrying stacked bundles of lumber must have wide enough bunks to carry standard widths of bundles.

Auto-rack rail road cars must be wide enough not only to carry automobiles, but they also must be wide enough to allow space for persons loading and unloading the automobiles to open the automobile doors and get in and out of the automobiles. The person loading the automobiles must also have sufficient space to walk beside the automobiles. When the clearance allowed is too small, the loading personnel may inadvertently damage the finish of the automobiles, giving rise to damage claims. Alternatively, it may be that it is helpful, or necessary, to allow a clearance envelope to accommodate motion of the lading during travel. In each case, it is helpful to lengthen the car to increase lading, but such lengthening is limited by the need to maintain a car body width.

Conventionally, articulated rail road cars have two or more rail car units permanently connected to each other such that one rail car truck is shared between two adjoining rail car units. Typically, an articulated rail road car having a number of rail car units 'n' is supported on 'n+1' trucks. An articulation connection is a permanent connection unlike a hitch or standard releasable coupling that can be coupled and uncoupled each time a new train consist is made up in a shunting yard. By contrast, an articulated connector, once assembled, tends only to be taken apart during repair or replacement at a workshop, and is considered a permanent connection.

In FIG. 1*b*, an articulated rail road car B20 has first and second rail car units B22 and B24. They are joined at their respective inboard ends B26 and B28 by an articulation connection B30 mounted directly above the truck center of a four wheel truck B32 that is shared between units B22 and B24. The track radius is shown as $R_1$. The allowable inside radius is shown as $R_2$. The allowable outside radius is shown as $R_3$. The extreme corners of outboard ends B34 and B36 fall just within radius $R_3$. When articulated truck B32 is used, while the inside of the body of car B20 is tangent to radius $R_2$, there is clearance between the outermost extremities of inboard ends B26 and B28. This occurs because truck B32, is constrained to follow the tracks, and there is no overhang of either unit B22 or unit B24 at truck B32 comparable to the overhang at each of the outboard ends B34 and B36.

Further, in the example of FIG. 1*b*, a vertically downward shear load is passed from each of car units B22 and B24 into articulation connection B30, and then directly into the truck bolster of truck B32. That is, each of the car units B22 and B24 approximates a span having a simple support at each end into which the vertical shear load, but no bending moment, is passed for reaction through the trucks, and ultimately, by the road bed lying underneath the rails. It will be appreciated that in a multi-unit articulated car having three or more car units, at least one unit will have an articulation connection under both ends.

FIG. 1*d* shows a three-unit articulated rail road car C20, having a middle rail car unit C22 and end rail car units C24 and C26. As in FIG. 1*b*, rail road car C20 is shown on a section of track having centerline radius $R_1$, minimum inside clearance radius $R_2$, and minimum outside clearance radius $R_3$. As before, the truck center distance is $L_1$, and the mid-span lateral inset of the longitudinal centerline of rail car unit C22 (and, in this example, also of rail car units C24 and C26), is again 61. As above, car unit C22 is joined to car units C24 and C26 by respective articulated connectors C28 and C30 whose points of articulation lie directly above corresponding shared trucks C32 and C34. It can be seen that the outside corners C36 and C38 of car unit C22, and corners C40 and C42 of car units C24 and C26 lie well inward of outside radius $R_3$.

The rail road cars shown in FIGS. 1*a*, 1*b* and 1*d* have pivoting, two axle, four-wheel trucks that pivot relative the longitudinal centerlines of the respective car bodies. This permits the truck to run along the arc while the car body forms a chord of the arc, the chord meeting the track centerline at an angle. Single truck railcars are known, particularly in light-weight service as for passenger car train sets where the individual axle loading levels tend to be low relative to the customary load limits of freight cars. The use of single axle trucks in an articulated freight car may tend to be disadvantageous.

First, a single axle truck is generally fixed relative to the car body. If allowed to pivot freely in the manner of a double axle truck, a single axle truck would not necessarily continue to follow the rails. However, as car length increases, fixed orientation single axle trucks face an increasing angle of attack relative to the rails when running through a curve. Consequently, single axle trucks tend not to be recommended for rail cars having a separation of more than about 39 feet between trucks. However, the issue of having to reduce the width of the rail road car occurs when the truck centers are already more than 46 ft. 3 in. apart. Second, a single axle truck cannot, in general, carry the same load as a double axle truck having comparable wheels. While single axle trucks may be suitable for the carriage of short, light passenger cars, the length and greater lading of freight cars tends to require double axle trucks.

As noted, in the arrangement shown in FIG. 1*b*, the articulated rail car units are able to pivot relative to the shared truck, and relative to each other. There is a permanent articulated connector, having a male member and female socket. The articulated connector has a pivot axis that is generally located directly above the center of the shared truck, such that the pivot point of the socket is coincident with the truck center when viewed from above. In this type of arrangement, the pivot point tends always to lie directly above the centerline of the track. One type of articulated connector is shown in U.S. Pat. No. 4,336,758 of Radwill, issued Jun. 29, 1982, in which the main pin is nominally vertical. Another type of articulation connection is shown in U.S. Pat. No. 5,271,511 of Daugherty, Jr., issued Dec. 21, 1993 in which a main pin, in the nature of a removable shaft, is nominally horizontal.

One advantage of articulated connections is that they tend to take up less longitudinal space than common interchangeable couplers. In one application, a number of large automobile manufacturing facilities have a loading siding length that is chosen to handle a string of cars, whether articulated or otherwise, or some combination thereof, up to a limit of 500 ft. in length. One automobile manufacturer would like to be able to load 4 automobiles of a type having a length of 239" (or less), or five compact automobiles on a single auto rack car, or, in the case of an articulated car, on a single car unit. When standard releasable couplers are used on stand alone cars, a 500 ft siding can accommodate 5 rail cars with an overall length of roughly 470', with a total capacity on a single deck level of 20 automobiles of 239 inch length each. A pair of three-pack articulated rail road cars made according to the present invention may tend to permit a six unit rail road car to be accommodated on a 500 ft siding with a total capacity on a single deck level of 24 automobiles of 239 inch length each.

Another advantage is that articulated couplers tend to be slackless couplers. This tends to reduce the longitudinal shock load transmitted during run-in and run-out, and during shunting. Other types of slackless coupling exist other than articulated couplings. For example, it is possible to use a draw bar between cars, as shown, for example, in U.S. Pat. No. 4,929,132 of Yeates et al., issued May 29, 1990.

A draw bar is a bar of fixed length that is connected at pivot points at either end to adjacent rail car units on either side. A draw bar reduces the clearance required between the car units as compared to releasable couplers, but cannot be used to transmit a shear load. That is, it may not tend to be advantageous to try to pass a vertical shear load through a draw bar. Thus use of a draw bar rather than an articulated connector generally requires that there be an adjacent truck mounted to each of the rail car units, with the consequent increase in weight, length, maintenance, and expense.

SUMMARY OF THE INVENTION

In an aspect of the invention there is an articulated rail road freight car having first and second rail car units connected at a cantilevered articulation.

In an additional feature of that aspect of the invention, each of the first and second rail car units has at least one deck upon which vehicles can be loaded. In another additional feature, the freight car has at least one member mounted to permit vehicles to be conducted between said first and second rail car units. In another additional feature, the freight car is an auto rack car having bridge plates mounted to permit automobiles to be conducted between rail car units. In another feature, the freight car is a three pack rail road car having a two truck middle unit and a pair of single truck end units.

In another aspect of the invention, there is an articulated rail road car having a plurality of rail car unit bodies carried on a plurality of rail car trucks, the rolling direction of the rail road car defining a longitudinal direction, the plurality of rail car bodies including a first rail car unit body and a second rail car unit body connected together at an articulation connection, the rail car trucks including a first rail car truck located closer to the articulation connection than any other, the first rail car truck being pivotally mounted to the first rail car body, and the articulation connection being eccentrically mounted relative to the first truck. In an additional feature of that aspect of the invention, the truck is a two axle truck mounted to pivot about a vertical truck center axis relative to the first car body, and the articulation connection is cantilevered longitudinally relative to the truck center In another aspect of the invention, there is an articulated rail road car, the car having a rolling direction defining a longitudinal direction on tangent track. The rail road car has first and second rail car units, and a plurality of rail car trucks upon which the railroad car is carried. The first and second rail car units are connected at an articulation connection. One of the rail car trucks is closest to the articulation connection, the closest rail car truck being mounted to the first rail car unit, and the articulation connection is mounted longitudinally eccentrically relative to the closest rail car truck.

In an additional feature of that aspect, the closest rail car truck is a two axle truck. In another additional feature, the first rail car unit has a body, and the closest rail car truck is mounted to pivot about a vertical truck center axis relative to the body of the first rail car unit. In another additional feature, the articulated connection has a first portion mounted to the first rail car unit, and a mating second portion mounted to the second rail car unit, the first and second portions meeting on a bearing interface defining a portion of a spherical surface. In still another additional feature, the articulation connection has a first portion rigidly mounted to the first rail car unit, and a mating second portion mounted to the second rail car unit, the articulation connection being capable of transferring a vertical shear load from the second portion to the first portion.

In another aspect of the invention, there is an articulated rail road car, the rail road car having a rolling direction on tangent track defining a longitudinal direction. The articulated rail road car includes first and second rail car units joined at an articulated connection. The first rail car unit has a first end proximate to the articulated connection, and a second end distant from the articulated connection. The first car unit has a first rail car truck pivotally mounted thereunder. The first rail car truck is located closer to the first end of the first rail car unit than to the second end of the first rail car unit, and the articulated connection is longitudinally eccentric relative to the first rail car truck.

In an additional feature of that aspect of the invention, the second rail car unit has a first end proximate to the articulated connection, and a second end distant from the articulated connection. The second rail car unit has a second rail car truck mounted thereunder. The second rail car truck is located closer to the second end of the second rail car unit than to the first end of the second rail car unit, and the second rail car unit is free of rail car trucks between the articulation connection and the second rail car truck. In a further additional feature, the articulation connection is a first articulation connection, and the rail road car has a third rail car unit joined to the second rail car unit at a second articulation connection.

In a further feature, the second articulation connection is mounted eccentrically relative to the second rail car truck. In still another additional feature, one articulation connection is a first articulation connection. The rail road car has a third rail car unit joined to the second rail car unit at a second articulation connection. The third rail car unit has a first end proximate to the second articulated connection, and a second end distant from the second articulated connection. The third car unit has a second rail car truck mounted thereunder, the second rail car truck being located closer to the first end of the third rail car unit than to the second end of the third rail car unit, and the second articulated connection is longitudinally eccentric relative to the second rail car truck.

In another additional feature, the rail road car is free of trucks between the first articulation connection and the second articulation connection. In still another feature the rail road car is free of trucks between the first and second trucks. In a further feature, the first rail car unit is supported by a second rail car truck, and the second rail car truck is located closer to the second end of the first rail car unit than to the second end of the first rail car unit. In still another feature, the articulation connection is a first articulation connection, and the rail road car includes a third rail car unit joined to the second end of the first rail car unit at a second articulation connection. In a still further feature, the second rail car truck is mounted underneath the first rail car unit, and the second articulation connection is longitudinally eccentrically located relative to the second rail car truck. In yet another additional feature, the first car unit is the middle car unit of a three unit pack. In another additional feature, the second and third rail car units each have a near end proximate to the first car unit, and a far end distant from the first car unit, and each of the second and third car units is supported by a respective rail car truck mounted closer to the far end than to the near end thereof.

In an additional feature of the invention, the rail car truck has a first pair of wheels mounted on a first axle, and a second pair of wheels mounted on a second axle. The first axle is longitudinally outboard relative to the second axle, and the articulation connection is longitudinally outboard relative to the first axle. In another additional feature, the first car unit has side bearing arms extending from the first end thereof toward the second car unit, and the second car unit has side bearing arms extending therefrom to engage the side bearing arms of the first car unit. In a farther additional feature the side bearing arms of the first car unit have bearing surfaces facing upward, and the side bearing arms of the second car unit have bearing surfaces facing downward.

In another additional feature the first car unit has a main bolster mounted over the first truck, and a center sill extending longitudinally outboard therefrom. The center sill has a distal end longitudinally distant from the main bolster, and the articulation connection is mounted to the distal end of the center sill. In still another feature, the center sill is a stub sill. In a further additional feature, first rail car unit has a well intermediate the first and second ends thereof.

In an alternate additional feature, the first unit has a main bolster mounted above the first truck, a center sill extending longitudinally outboard of the first truck toward the second rail car unit. An endmost lateral structural member, (whether an end bolster or and end sill), extends transversely relative to the center sill, the endmost lateral structural member being located longitudinally outboard of the main bolster, and the center sill has a distal end outboard of the endmost lateral structural member to which the articulation connection is mounted. In an additional feature, the first car unit has longitudinally extending members located transversely outboard and to either side of the center sill. The longitudinally extending members run between the main bolster and the endmost lateral structural member. The longitudinally extending members extend longitudinally beyond the endmost lateral structural member to define a first pair of side bearing arms. The second car unit has a second pair of side bearing arms mounted thereto, located to engage the first pair of side bearing arms.

In another additional feature, the first car unit has longitudinally extending side sills connected to the main bolster and the end bolster. The first car unit has longitudinally extending members each located intermediate the center sill and a respective one of the side sills. The longitudinally extending members run between the main bolster and the end bolster. The longitudinally extending members extend longitudinally outboard beyond the end bolster to define a first pair of side bearing arms; and the second car unit has a second pair of side bearing arms mounted thereto, located to engage the first pair of side bearing arms.

In another aspect of the invention there is an articulated rail road car having first and second rail car units joined at an articulation connection. The first rail car unit has a first end proximate the articulation connection and a second end distant from the articulation connection. The first rail car unit is mounted upon a pair of first and second rail car trucks located under the first and second ends of the first rail car unit respectively and being pivotable relative thereto about truck center axes. The first rail car unit has a pair of first and second main bolsters located at either end thereof, the main bolsters being mounted over the first and second rail car trucks respectively. The rail car has structure connected to maintain the main bolsters in position relative to each other. The first rail car unit has a center sill extending outboard of the first main bolster toward the second rail car unit, the center sill having an outboard end. The articulation connection is mounted to the outboard end of the center sill.

In an additional feature of that aspect of the invention, the second rail car unit has a first end proximate the articulation connection and a second end distant from the articulation connection. The second rail car unit is mounted upon a third rail car truck located under the second end of the second rail car unit, and the second rail car unit is free of trucks between the third rail car truck and the articulation connection. In an additional feature of that additional feature, the articulated connection is a first articulation connection. The rail road car has a third rail car unit connected to the second rail car unit at a second articulation connection. The second rail car unit has a main bolster mounted above the third rail car truck. The second rail car unit has a center sill extending outboard of the third rail car truck toward the third rail car unit. The center sill of the second rail car truck having a distal end distant from the third truck, and the second articulation connection is mounted to the distal end of the center sill of the second rail car unit.

In another additional feature, the third rail car unit has a first end proximate the second articulation connection and a second end distant from the second articulation connection. The third rail car unit is mounted upon a fourth rail car truck located under the second end of the third rail car unit, and the third rail car unit is free of trucks between the fourth rail car truck and the second articulation connection.

In another additional feature, the articulation connection is a first articulation connection, the outboard end of the center sill is a first end thereof, and the rail road car has a third rail car unit connected to the second end of the first rail car unit at a second articulation connection. In still another additional feature, the center sill is a through center sill having a second end located outboard of the second main bolster, and the second articulation connection is mounted to the second end of the center sill.

In a still further additional feature, the third rail car unit has a first end proximate the second articulation connection and a second end distant from the second articulation connection. The third rail car unit is mounted upon a fourth rail car truck located under the second end of the third rail car unit, and the third rail car unit is free of trucks between the fourth rail car truck and the second articulation connection.

In another aspect of the invention, there is an articulated rail road car having a number of rail car units. The units include at least a first rail car unit, a second rail car unit, and a third rail car unit, the second rail car unit lying between the first and third rail car units. The articulated rail road car has a number of rail car trucks mounted to support the rail car units, the number of rail car trucks being equal to the number of rail car units plus one. The first rail car unit is connected to the second rail car unit at a first articulation connection. The second rail car unit is connected to the third rail car unit at a second articulation connection. None of the rail car trucks is mounted centrally under either of the first and second articulation connections.

In an additional feature of that aspect of the invention, the rail road car is free of trucks between the first and second articulation connections. In a further feature, each of the first and second rail car units is supported by a spaced apart pair of the rail car trucks mounted thereunder. In a still further feature, each of the first and third rail car units has a cantilever member extending toward the second rail car unit, and the first and second articulation connections are mounted respectively to the cantilever members of the first and third rail car units. In a still further feature, a fourth rail car unit is connected to the third rail car unit at a third articulated connection. The third rail car unit has a first end adjacent the second articulation connection and a second end adjacent the third articulation connection The first rail car unit is supported by a pair of the rail car trucks, namely first and second spaced apart rail car trucks mounted thereunder. A third one of the rail car trucks is mounted under the first end of the third rail car unit. In still another feature, a fourth rail car unit is connected to the first rail car unit at a third articulated connection. A fifth rail car unit is connected to the third rail car unit at a fourth articulated connection. The first rail car unit has a first end adjacent the first articulation connection and a second end adjacent the third articulation connection. The third rail car unit has a first end adjacent the second articulation connection and a second end adjacent the fourth articulation connection. A first of the rail car trucks is mounted under the first end of the first rail car unit. A second of the rail car trucks is mounted under the first end of the third rail car unit.

In a still further aspect of the invention, there is an articulated rail road car wherein, when standing on tangent track, the rail road car has a first rail car unit and a second rail car unit. The first and second rail car units are joined at an articulated connection. Each of the first and second rail car units has a proximal end near the articulated connection, and a distal end lying far from the articulated connection. The distal end of the first rail car unit is supported by a first rail car truck. The distal end of the second rail car unit is supported by a second rail car truck. A third rail car truck is mounted to the rail road car between the first and second trucks. The rail road car is free of trucks between the first and second trucks other than the third truck. The third truck is spaced from the first truck a first distance, $D_1$. The articulation connection is spaced from the first truck a second distance, $D_2$. The first distance, $D_1$, is less than the second distance, $D_2$.

In an additional feature of that aspect of the invention, the third truck is spaced from the second truck a third distance, $D_3$, and $D_3$ is different from $D_1$. In a further feature, $D_3$ is greater than $D_1$. In an alternative feature, the third truck is spaced from the articulated connection a third distance, $D_3$. The second truck is spaced from the articulated connection a fourth distance, $D_4$, and $D_4$ is greater than $D_3$ In a further feature, the third rail car truck is pivotally mounted to the first rail car unit and the first distance, $D_1$; is greater than 46 ft.-3 in.

DETAILED DESCRIPTION OF THE INVENTION

Figure 1A:
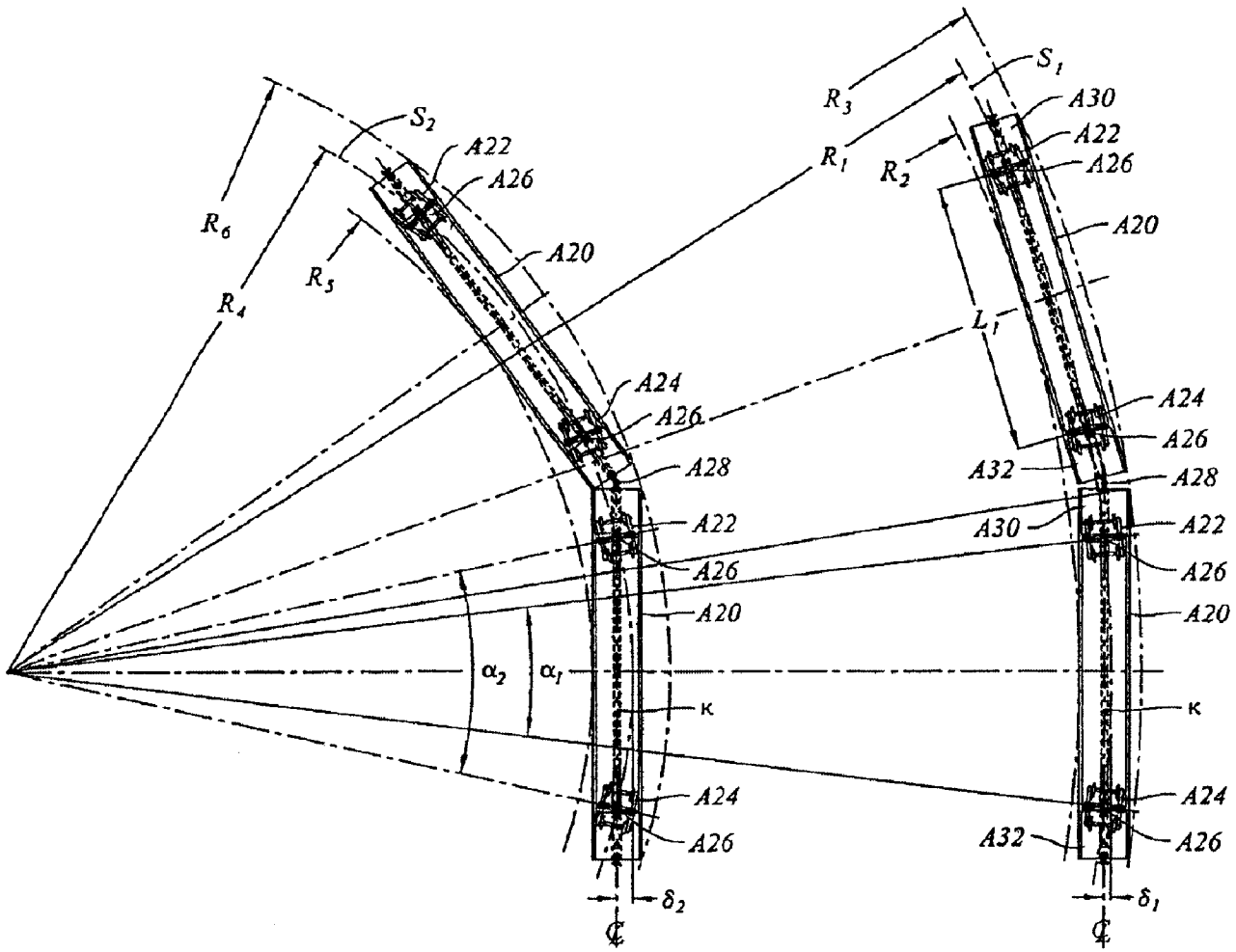
FIG. 1*a* shows a conceptual top view of two rail road cars on curved tracks.
Figure 1B:
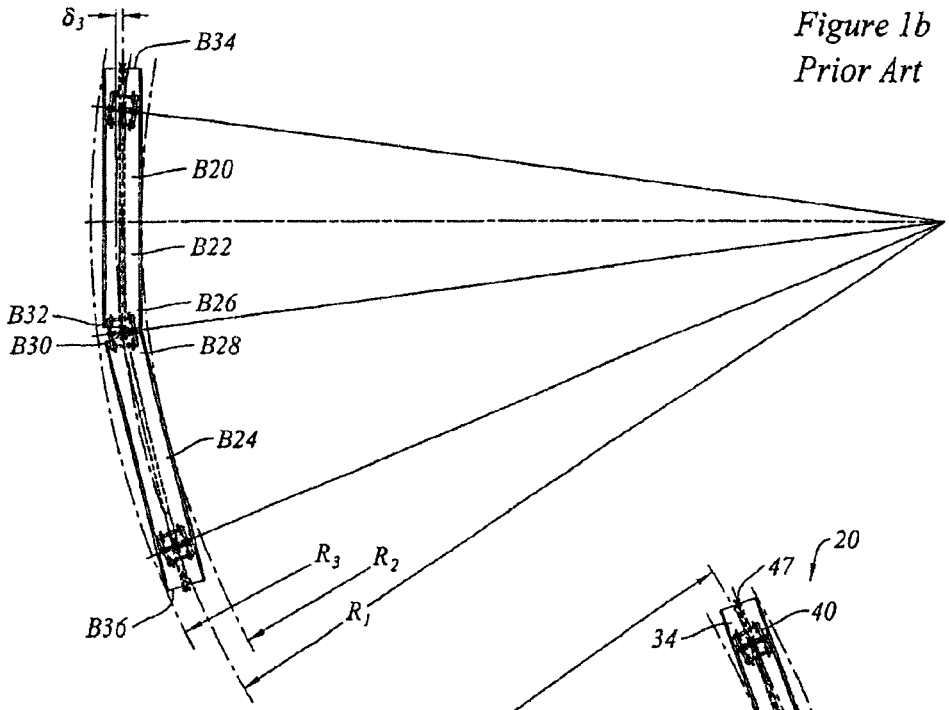
Figure 1b Prior Art
FIG. 1*b* shows a conventional two-unit articulated rail road car on a curved track.

The description which follows, and the embodiments described therein, are provided by way of illustration of an example, or examples of particular embodiments of the principles of the present invention. These examples are provided for the purposes of explanation, and not of limitation, of those principles and of the invention. In the description which follows, like parts are marked throughout the specification and the drawings with the same respective reference numerals.

In terms of general orientation and directional nomenclature, for each of the rail road cars described herein, the longitudinal direction is defined as being coincident with the rolling direction of the car, or car unit, when located on tangent (that is, straight) track. In the case of a car having a center sill, whether a through center sill or stub center sill, the longitudinal direction is parallel to the center sill, and parallel to the side sills, if any. Unless otherwise noted, vertical, or upward and downward are terms that use top of rail TOR as a datum. The term lateral, or laterally outboard, refers to a cross-wise distance or orientation relative to the longitudinal centerline of the rail road car, or car unit, indicated as CL—Rail Car. The term "longitudinally inboard", or "longitudinally outboard" is a lengthwise distance taken relative to a mid-span lateral section of the car, or car unit.

Figure 1C:
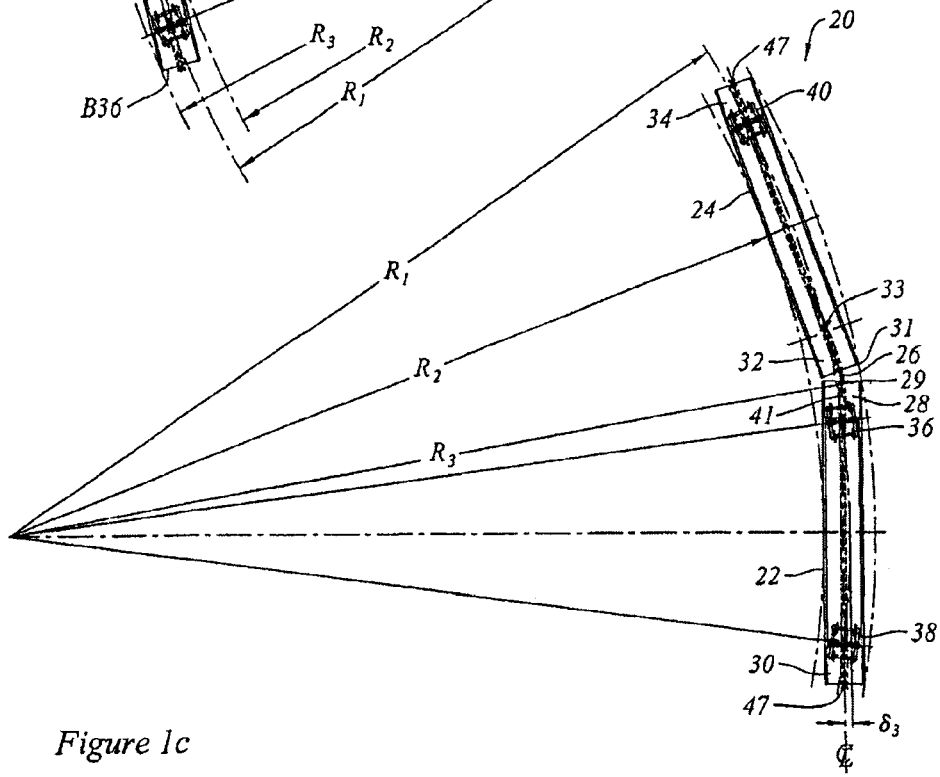
FIG. 1*c* shows a conceptual top view of a two unit articulated rail road car according to the present invention, on a curved track.
Figures 2A, 2B:
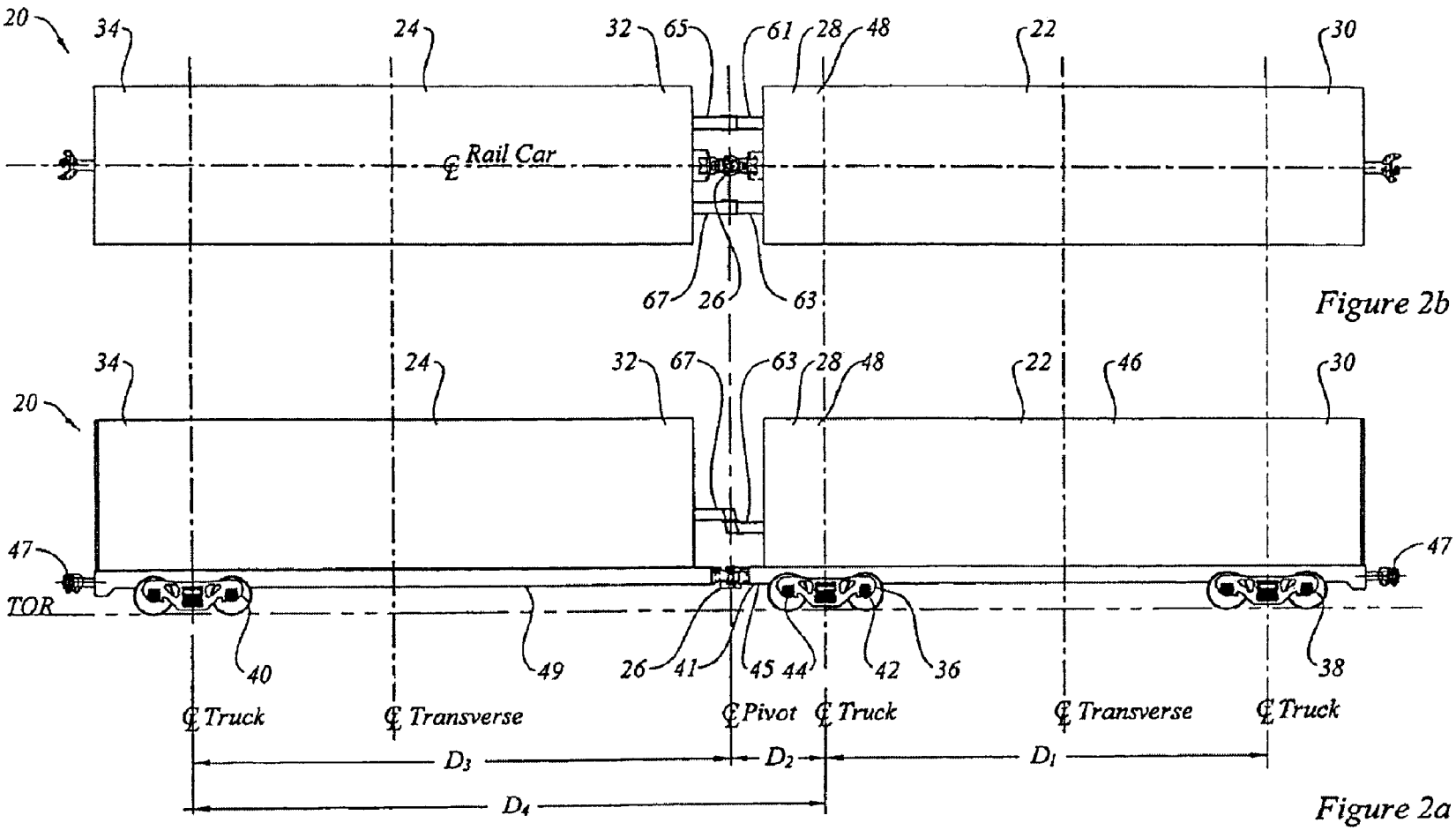
FIG. 2*a* shows a side view of the two unit articulated rail road car of FIG. 1*c* as on straight track.
FIG. 2*b* shows a top view of the rail road car of FIG. 1*c* as on straight track.

An articulated rail car is indicated in FIG. 1*c* and FIGS. 2*a* and 2*b* generally as 20. Car 20 is preferably an auto-rack rail road car, but could be another type of rail road freight car, such as a well car, a gondola car, a center-beam car, a spine car, a flat car, a box car, or other type of rail road car. It has a first rail car unit 22 and a second rail car unit 24. They are joined by a connection that may be conceptually idealised as a pin joint capable of transferring a longitudinal axial load and a shear load in any of two axes, but not a bending moment, in the nature of an articulation connection 26 located between units 22 and 24. First rail car unit 22 has a pair of first and second ends, 28 and 30, that are, respectively, proximate to and distant from articulation connection 26. Second rail car unit 24 has two ends, 32 and 34 that are, similarly, proximate and distal ends respectively relative to articulation connection 26. Rail car unit 22 is carried upon, and supported by, two longitudinally spaced rail car trucks 36 and 38 that are located under respective first and second ends 28 and 30 The nominal vertically extending pivot axis of articulation connection 26 is indicated as a centerline, 'CL—Pivot'. The truck centers are each indicated as 'CL—Truck' The mid-span centerline of unit 22 is indicated as 'CL—Transverse'.

Second rail car unit 24 is supported at its distal end on a single truck 40, located under distal end 34. That is, truck 40 is located closer to distal end 34 of rail car unit 24, than to proximal end 32 of rail car unit 24. Support for proximal end 32 is provided through articulation connection 26. Notably, articulation connection 26 is not mounted directly upon, or above, a truck, but rather is carried at the end of a cantilever 41 extending longitudinally from truck 36 toward rail car unit 24. As can be seen, rail road car 20 is free of trucks between truck 36 and truck 40, and hence between articulation connection 26 and truck 40.

Each of trucks 36, 38 and 40 is a double axle truck of customary North American construction, having a truck bolster extending perpendicular to the rail road track, a pair of side frames mounted to the laterally outboard ends of the bolster, and two pairs of wheels, each pair of wheels being mounted on a respective one of a pair of spaced apart axles carried in the side frames. Each of trucks 36, 38 and 40 is free to pivot, or swivel, about the vertical axis of the truck center relative to the body of its respective rail car unit generally, as may be determined by its path along the rails. For example, truck 36 has two axles, a first axle 42 and a second axle 44 spaced equally to either side of the truck center. Axle 42 lies longitudinally inboard of axle 44 relative to the body 46 of first car unit 22. Car body 46 has an overhanging portion 48 extending outboard of the truck center of truck 36, between truck 36 and articulation connection 26. Other types of truck are known, such as three axle trucks and single axle trucks, and could be used in place of truck 36. Steerable trucks are a included among the other types of trucks.

For the purposes of the present description, unless otherwise stated, distances are measured between the various pivot and truck centers. The distance between the truck centers of trucks 36 and 38 is indicated in FIG. 2*a* as $D_1$. The distance from the truck center of truck 36 to articulation connection 26, namely the cantilever distance, is shown as $D_2$. The distance from articulation connection 26 to the truck center of truck 40 is indicated as $D_3$. The distance between the truck centers of trucks 36 and 40, when car 20 is sitting on tangent (i.e., straight) track is indicated as $D_4$. The truck arrangement is asymmetric relative to articulation connection 26 That is, $D_1$ is not equal to the distance between truck 38 and articulation connection 26, (as it would be, for example, with a conventional shared truck located beneath the articulated connector, symmetrically between two rail car bodies). The difference in distance is the length of cantilever 41, that is, $D_2$ Similarly, in the illustrated embodiment of FIG. 2*a*, $D_3$ equals $D_1$ plus $D_2$, although in the general case this need not be so.

As noted above, the cantilever distance $D_2$ is measured from (a) the pivot connection of truck 36 (that is, the truck center of truck 36) to (b) the pivot axis, CL—Pivot, of articulation connection 26. As is evident, the pivot axis is neither longitudinally co-incident with the truck center of the nearest adjacent truck, namely truck 36, nor is it carried over the body of truck 36, nor over any other truck. Rather, not only is the pivot axis, CL—Pivot, longitudinally eccentric relative to the closest truck center, namely that of truck 36, but moreover, it is cantilevered longitudinally outboard of axle 44, and of truck 36 entirely. The structure of car body 46 is such as to permit the vertical shear load passed from second rail car unit 24 through articulation connection 26 to be carried to truck 38.

In the embodiment illustrated in FIG. 2*a*, a rigid center sill 45 is mounted to car body 46, and runs longitudinally inboard above truck 36. Generally, the center sill can be either (a) a through center sill extending fully from articulated connection 26 to coupler 47 at the distal end of first car unit 22, running above both truck 36 and truck 38; or (b) alternatively, it can be a stub center sill, as may be advantageous to permit a well to be defined between first and second ends 28 and 30, with another stub sill being mounted over truck 38 and extending outwardly thereof to a distal end having releasable coupler 47 mounted thereto. Coupler 47, and all other releasable couplers described herein, are of a type such as to permit, for example, interchangeable service with rail road freight cars in general service in North America. Similarly, rail car unit 24 has a rigid straight-through center sill 49 running inboard of a releasable coupler 47, above truck 40, to articulation connection 26.

Figure 2C:
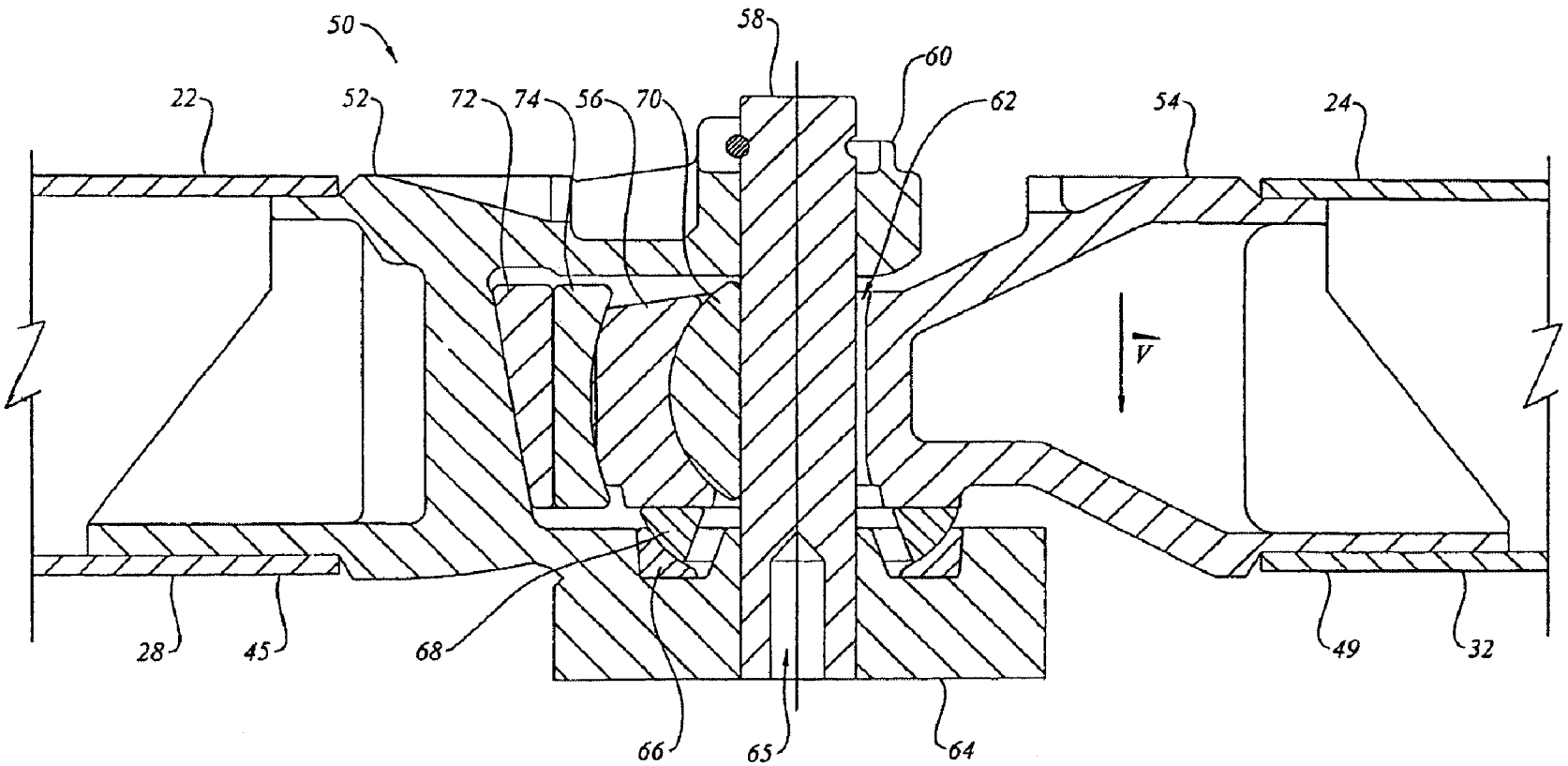
FIG. 2*c* shows a cross-section of an illustrative articulated connector suitable for use the articulated rail road car of FIG. 2*a;*

Articulation connection 26 (and the other articulated connections noted herein) is preferably a steel articulated connector, indicated generally in FIG. 2*c* as 50, similar to those commonly available from manufacturers such as Westinghouse Air Brake (WABCO) of Wilmerding Pa., or American Steel Foundries (ASF), also known as Amsted Industries Inc., of Chicago Ill. The general form of one type of articulated connector (with a vertical pin) is shown, for example, in U.S. Pat. No. 4,336,758 of Radwill, issued Jun. 29, 1982. In general, this kind of permanent, articulated connection has a female member, in the nature of a female socket 52 mounted to a center sill of one articulated rail car unit (in this instance center sill 45 of unit 22), and a male member 54 mounted to an adjacent rail car unit, (in this instance center sill 49 of unit 24), as shown in FIG. 2*c*. FIG. 2*c* is not necessarily to scale, and may not show all detail features of an articulated connector. It is provided for the purposes of conceptual illustration.

Male member 54 has an extension, or nose, 56 that seats in female socket 52. A main pivot pin 58 extends through a bore defined in top plate 6G of socket 52, through a bore, or passage 62 in male member 54, and through the base plate 64 of female socket 52. Pivot pin 58 is nominally vertical. That is, on straight, level track pin 58 is vertical. In a conventional arrangement in which the articulated connection is mounted over a truck, another pin may extend from blind bore 65 of pin 58 to seat in the central bore in the truck center plate. Notably, in the embodiment illustrated in FIG. 2*b*, pin 58 is not supported over a truck.

Male member 54 has three rotational degrees of freedom relative to female socket 52. First, it can yaw about the main pivot axis, as when the car units negotiate a bend or switch. Second, it can pitch about a transverse horizontal axis, as when the car units change slope at the trough of a valley or the crest of a grade. Third, the car units can roll relative to each other, as when entering or leaving super-elevated cross-level track, (that is, banked track). It is not intended that male member 54 have any translational degrees of freedom relative to female socket 52, such that a vertically downward shear load V can be transferred from male member 54 into female socket 52, with little or no longitudinal or lateral play. To permit these motions, female socket 52 has spherical seat 66 having an upwardly facing bearing surface describing a portion of a spherical surface. Another mating spherical annular member 68 sits atop seat 66, and has a mating, downwardly facing, bearing surface describing a portion of a sphere such that a spherical bearing surface interface is created. Member 68 also has an upwardly facing surface upon which male member 54 sits. An insert 70 has a cylindrical interface lying against pin 58, and a spherical surface that engages a mating spherical surface of passage 62 lying on the inside face of nose 56. A wedge 72 and wear plate 74 are located between nose 56 and the inner wall, or groin, 76, of female socket 52. Wear plate 74 has a vertical face bearing against wedge 72, and a spherical face bearing against a mating external spherical face of nose 56. Wedge 72 bears against wear plate 74, as noted, and also has a tapered face bearing against a corresponding tapered face of groin 76. The tapers are formed such that as wear occurs, gravity will tend to urge wedge 72 downwardly, tending to cause articulated connector 50 to be longitudinally slackless.

In the example of FIGS. 2*a* and 2*b*, it is preferred that male member 54 be mounted to the end of the center sill (e.g., 49) of the car unit end that does not have a truck, such as end 32 of car unit 24, and that female socket 52 be mounted to center sill 45 of the two-truck car unit 22. In this way the vertical shear from car unit 24 is transferred into the cantilevered overhang of car unit 22 through the spherical interface. By way of an alternative, it appears that in principle, male member 54 could be mounted inversely on car unit 22, and female socket 54 could be mounted inversely on car unit 24, with appropriate changes in the location and orientation of the annular members and spherical interfaces, and in the operation of the wedge and wear plate. However, for simplicity, it is advantageous to use existing articulated connectors, installed in the upright orientation addressed above.

The scope of the allowable roll of one car unit relative to the next adjacent car unit is limited by a pair of side-bearing arms 61, 63 mounted to rail car unit 22, and mating side-bearing arms 65, 67 mounted to rail car unit 24. In FIGS. 2*a* and 2*b*, side bearing arms 61, 63 and 65, 67 are shown at a higher elevation than articulation connection 26. This is done for the purposes of conceptual illustration only. In general, side bearing arms tend to be mounted at a height at which their bearing interfaces lie in, or are roughly level with, the horizontal plane (when the cars units are sitting on straight, level track) passing through the center of curvature of the spherical surfaces of the articulated connector. All of the rail road car embodiments described herein employ side-bearing arms, the side bearing arms of the adjacent first and second rail car units being mutually engaging. The side bearing arms have been omitted, for clarity, from FIGS. 3*a* to 5*e*, 6*a*, 6*f*, and 7*a* to 8*b*.

Figures 3A, 3B, 3C:
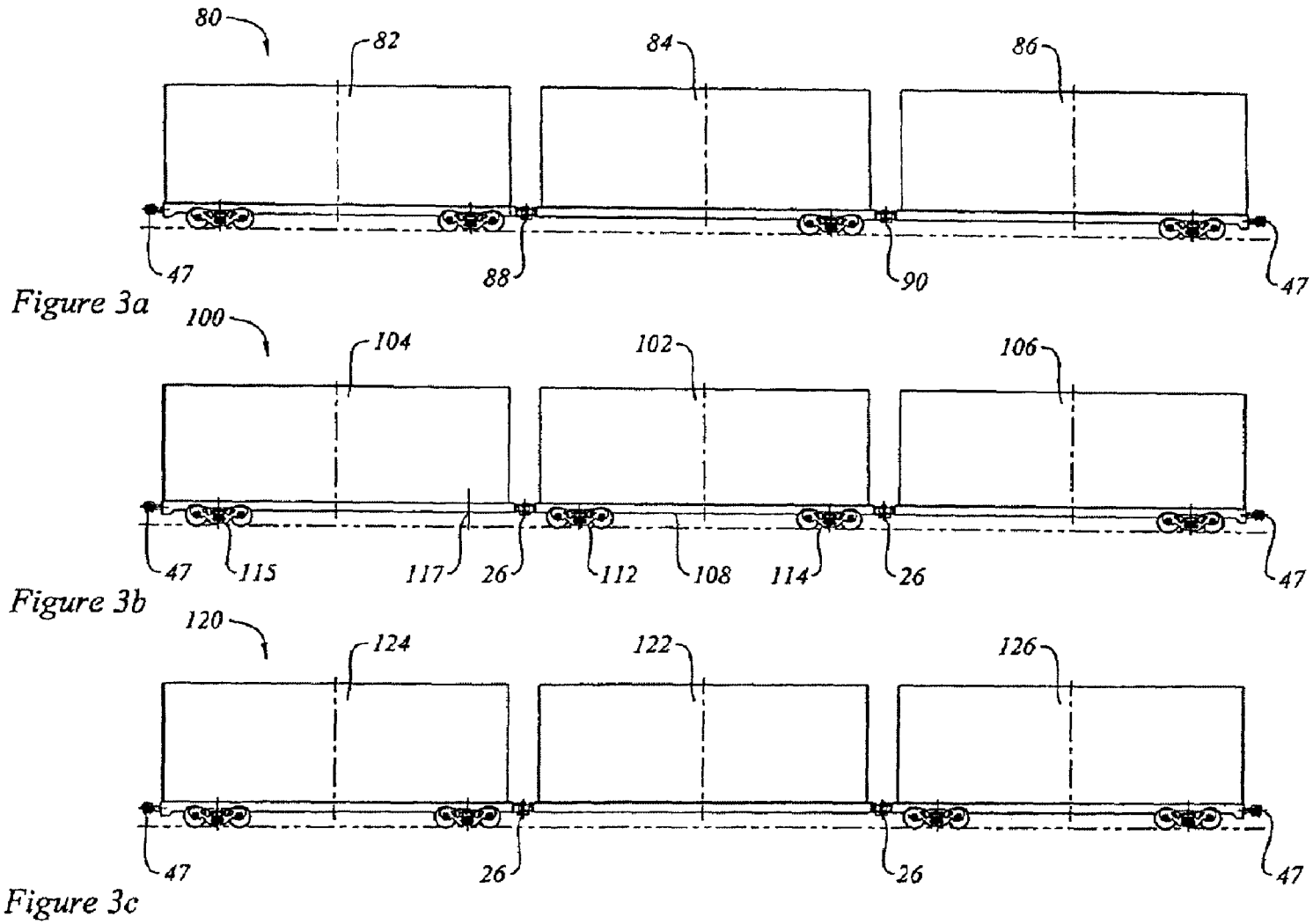
FIG. 3*a* shows a side view of a three unit articulated rail road car, being an alternate embodiment of articulated rail road car to that of FIG. 2*a;*
FIG. 3*b* shows a side view of an alternate three unit rail road car to FIG. 3*a;*
FIG. 3*c* shows a side view of another alternate three unit rail road car to FIG. 3*a;*

In the embodiment of FIG. 3*a*, an articulated rail road car 80 has first, second, and third rail car units 82, 84, and 86. Rail car units 82 and 84 are joined together by an articulation connection 88, the female portion, or socket being mounted to unit 82, and the male portion being mounted to unit 84. Rail car units 84 and 86 are also joined together by an articulation connection 90, the female portion of connector 90 being mounted to unit 84, and the male portion being mounted to unit 86. Rail car unit 82 is substantially the same as rail car unit 22 described above. Rail car unit 84 is substantially the same as rail car unit 24 described above, but has articulation connections mounted at both ends, namely 88 and 90. Rail car unit 86 is substantially the same as rail car unit 24.

Figure 4A:
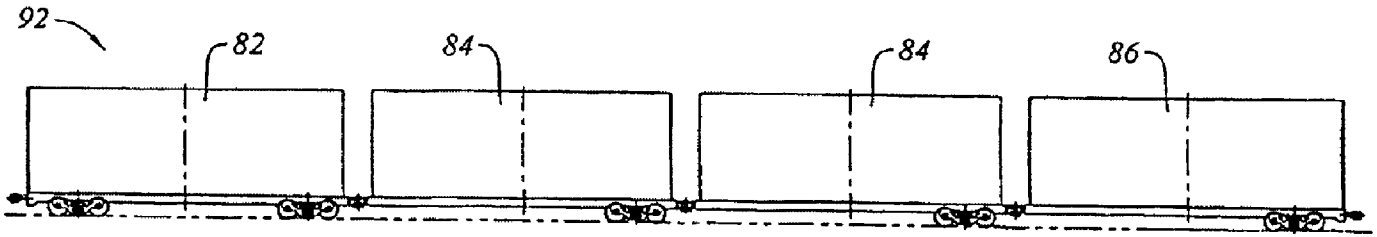
FIG. 4*a* shows a side view of a four unit articulated rail road car, being an alternate embodiment of articulated rail road car to that of FIG. 2*a;*
Figures 5A, 5B, 5C, 5D, 5E:
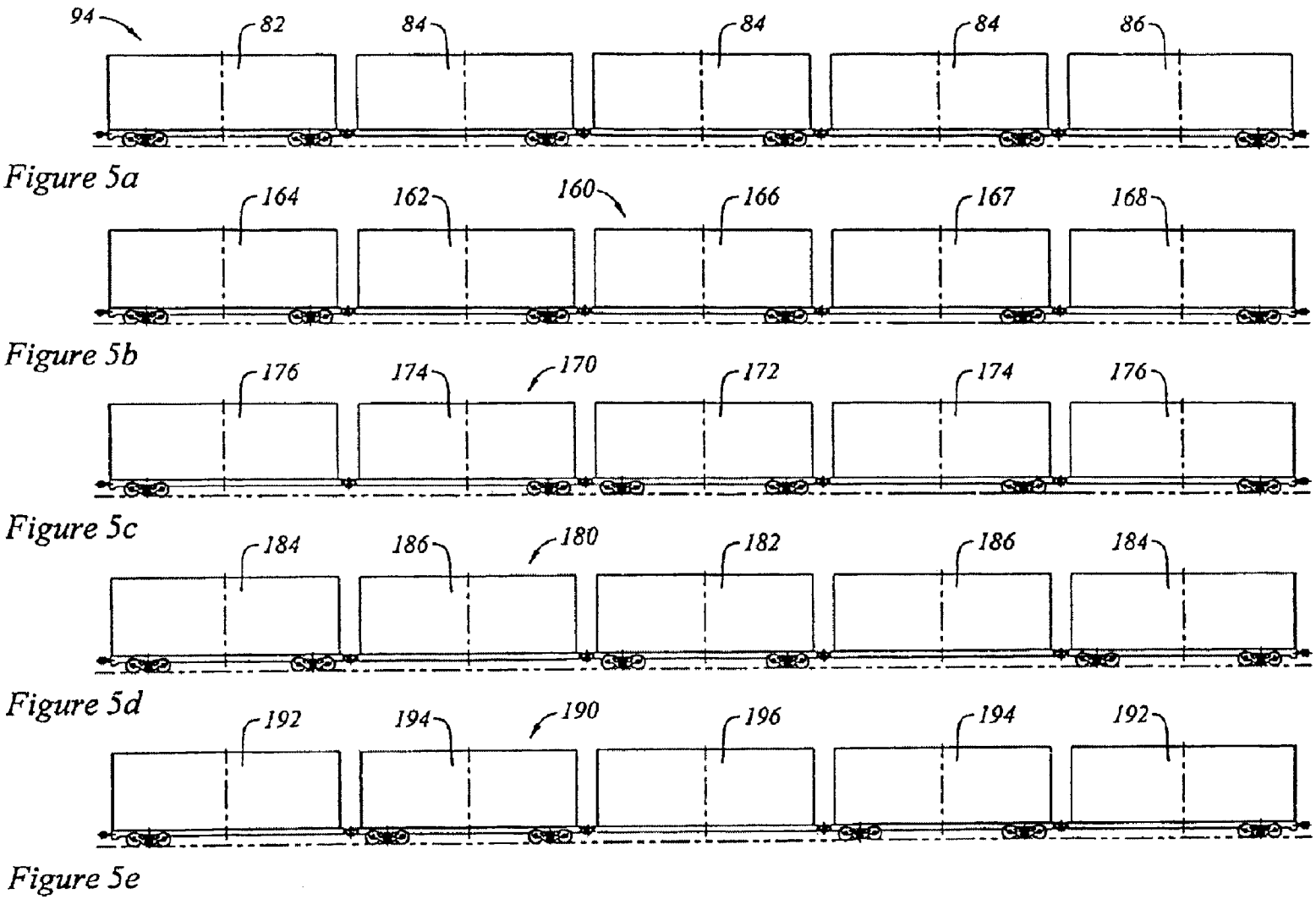
FIG. 5*a* shows a side view of a five unit articulated rail road car, being an alternate embodiment of articulated rail road car to that of FIG. 2*a;*
FIG. 5*b* shows a side view of an alternate five unit articulated rail road car to the articulated rail road car of FIG. 5*a;*
FIG. 5*c* shows a side view of another alternate five unit articulated rail road car to the articulated rail road car of FIG. 5*a;*
FIG. 5*d* shows a side view of a further alternate five unit articulated rail road car to the articulated rail road car of FIG. 5*a;*
FIG. 5*e* shows a side view of still another alternate five unit articulated rail road car to the articulated rail road car of FIG. 5*a;*

It will be understood that additional rail car units having articulation connections at both ends, such as rail car unit 84, can be added intermediate rail car end units having one releasable coupler end, such as rail car units 82 and 86, to yield a longer string of rail car units. A four-unit rail road car having a further intermediate unit 84, example is shown in FIG. 4*a* as 92. A 5-unit rail road car having three intermediate units 84 is shown in FIG. 5*a* as 94.

In the embodiment of FIG. 3*b*, an articulated three-pack rail road car is indicated generally as 100. It has a middle unit 102 and a pair of first and second end units 104 and 106. Middle unit 102 is substantially similar to unit 22 described above. However, it differs in having cantilevered articulation connections 26 mounted at both ends of a through center sill 108. Each of end units 104 and 106 is a single truck unit substantially the same as unit 24 described above. Middle unit 102 is a two truck unit, and can be thought of conceptually as a car unit made up of two articulation connection ends joined together. Each of the ends of unit 102 has a female portion of respective articulations connection 26, the corresponding male portions being mounted on units 104 and 106. Articulation connections 26 are mounted longitudinally outboard of respective first and second two-axle, four wheel swivel mounted (i.e., pivoting) trucks 112 and 114. As above, the pivot axis of the articulation connections is thus eccentric relative to the closest respective truck center.

In the embodiment of FIG. 3*c*, an alternative articulated three-pack rail road car is indicated generally as 120. It has a middle unit 122 and a pair of end units 124 and 126. Each of end units 124 and 126 is the same as unit 22 described above. Middle unit 122 is a truckless unit, being supported at the articulation connection 26 at either end. That is, rail road car 120 is free of trucks between the longitudinally inboard trucks 128 and 129 of units 124 and 126 respectively. As above, each articulation connection 26 includes a male portion mounted to car unit 122 and mating with female portions mounted to end units 124 and 126.

In the embodiments of cantilevered articulation connection shown and described above, in contrast to the shared-truck articulation connection B30 of rail road car B20, and the shared truck articulation connections of rail car C20, the articulation points of the articulated connectors of rail road cars 20, 80, 100, and 120 lie to the outside of the track centerline as the rail road car moves along a curve. This is shown, for example, by articulation connection 26 in FIG. 1*c*, and by articulated connections 26 of rail road car 100 in FIG. 1*e*. This outward position relative to the track centerline locates the outer corners 29 and 31 rail car units 22 and 24 adjacent to articulated connection 26 outboard, closer to $R_3$. The offset distance, $\delta_3$, of rail road car units 22 and 24 is the same as $\delta_1$ shown for rail car units B22 and B24. The length of car unit 22 exceeds the length of car unit B22 by the length of the overhang, while tending not to require a reduction in car body width relative to car unit B22. Similarly, rail car unit 24 also exceeds the corresponding length of rail car unit B24 by the same, or roughly the same, overhang distance since the point at which the rail car body centerline of rail car unit 24 crosses over the track centerline longitudinally inboard of articulation connection 26, indicated roughly as 33 in FIG. 1*c*, is roughly equivalent to the point at which rail car unit B24 has articulation connection B30. Thus rail car unit 24 is longer than rail car unit B24, and yet may tend not to require a reduction in width relative to car unit B24.

Figures 1D, 1E:
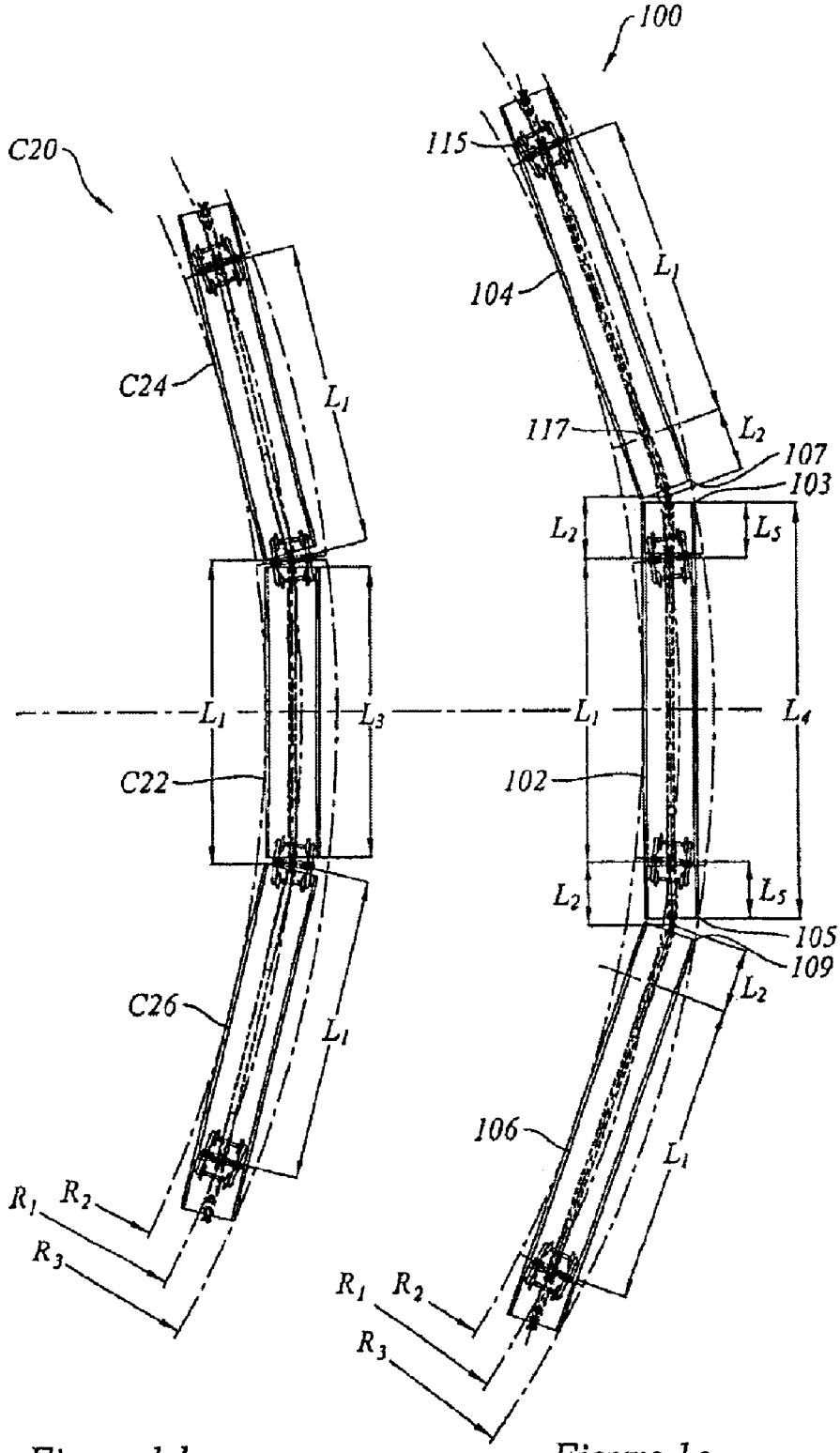
Figure 1d Prior Art
FIG. 1*d* shows a conventional three-unit articulated rail road car on a curved track.
FIG. 1*e* shows a three unit articulated rail road car, an alternative to the two-unit articulated rail road car of FIG. 1*c*, on curved track.
Figure 1F:
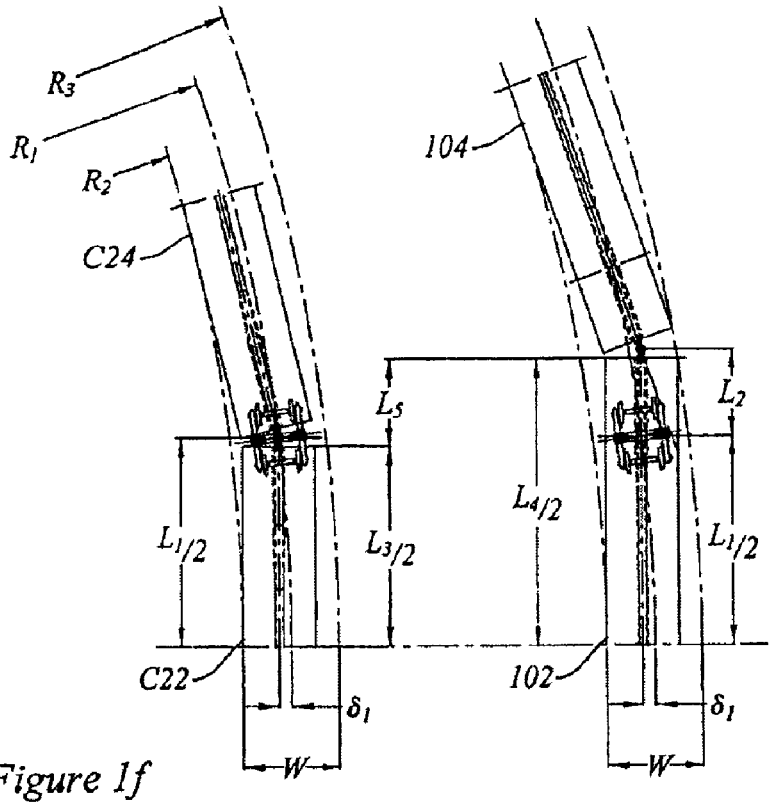
Figure 1f Prior Art
FIG. 1*f* is a comparison view of the three unit articulated rail road cars of FIGS. 1*d* and 1*e;*

The comparisons of FIGS. 1*d*, 1*e* and 1*f*, show a first difference between rail road car C20 and rail road car 100. Although the width 'W' of car unit 102 is the same as car unit C22, and the truck center distance, $L_1$, is also the same, the length of car unit 102 between the points of articulation is greater, being equal to $L_1$ plus twice the length of the cantilever distance $L_2$ to the articulation connections 26 at each end of car unit 102 Whereas the car body length $L_3$ of rail car unit C22 is shorter than the truck center distance, $L_1$, by contrast, the car body length $L_4$ of rail car unit 102 exceeds the truck center distance $L_1$ by twice the body overhang dimension, $L_5$. Notably, while the external corners of car unit C22 lie well clear on the inside of $R_3$, the external corners 103 and 105, and adjacent comers 107 and 109 of car units 104 and 106 respectively, are shown running along $R_3$. The car body length, ($L_3$ for car unit C20, $L_4$ for car unit 102) is a measure of the useful loading length, and is taken in each case as the overall deck length dimension over the endmost lateral cross members, whether end sills or end bolsters, as the case may be, of the rail car unit. In each case, (a) the point of articulation (i.e., the pivot centerline) lies longitudinally outboard of the end sill, or end bolster; and, (b) the end sill or end bolster lies longitudinally outboard of the of the nearest truck center pivot axis.

Figure 1G:
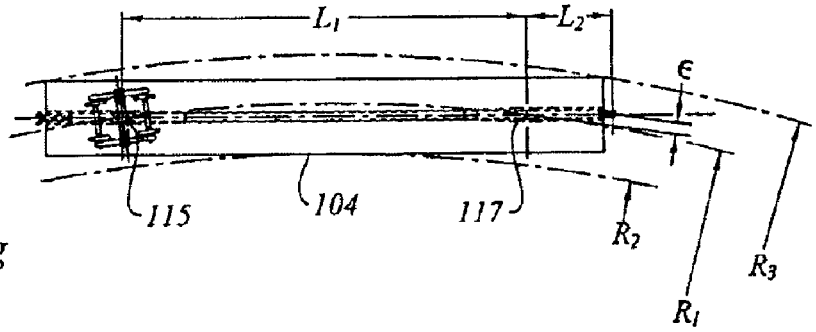
FIG. 1*g* is a conceptual view of a part of the rail road car of FIG. 1*d;*
Figure 1H:
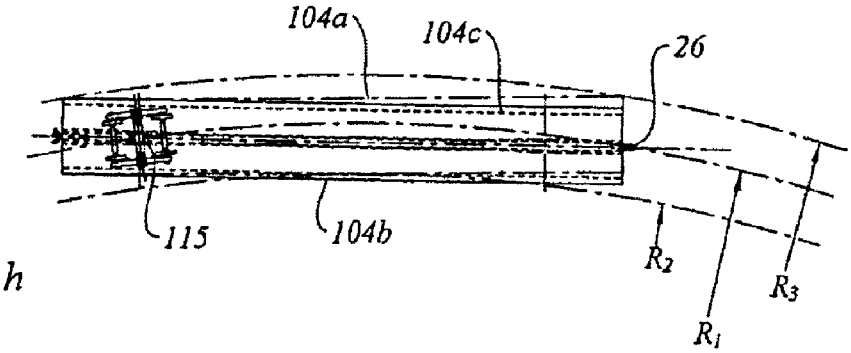
FIG. 1*h* is a further conceptual view of the rail road car of FIG. 1*d;*

The comparison illustrations of FIGS. 1*g* and 1*h* show a second effect. End car unit 104 is longer than end car unit C24, again by the overhang distance, indicated as $L_2$. For the purposes of simplicity of explanation and illustration, the car bodies in all of FIGS. 1*a* to 1*h* have been shown as being rectangular, with no tapering of their ends. Similarly, as illustrated in FIG. 1*e*, the length of car unit 104 has been chosen such that the distance from the truck center of its single truck to articulation connection 26 between rail car units 102 and 104 is equal to $L_1$ plus $L_2$. It is then a matter of geometry that the longitudinal centerline of car unit 104 will fall over the centerline of the track at a "phantom truck center" location, indicated as 117, located $L_1$ away from the truck center of truck 115. In a conventional articulated car unit, such as car unit C24, this would be the location of the point of articulation, and hence of a shared truck of a shorter car unit. However, as noted, car unit 104 extends beyond this point of intersection, and the rail car unit centerline diverges from the track centerline. This divergence is called swing-out.

The swing-out of the point of articulation is defined as the distance, measured perpendicular to the track centerline, from the track centerline to the pivot axis of the point of articulation. It is shown in FIG. 1*g* as $\epsilon$. In a conventional articulated rail road freight car $\epsilon$ is nil, since the point of articulation is coincident with the pivot axis of the shared truck, and rides over the track centerline as shown in FIG. 1*h*.

The outline of the body of rail car unit 104 is shown in FIG. 1*h* in intermittent dashes and dots, and indicated as 104*a*. It has width 'W', the same as unit 102. The outline of the body of rail car unit 104, as if it had no swing-out (i.e., $\epsilon$=zero) is shown in solid line as 104*b*, also being of width 'W'. As can be seen, the inside edge of 104*b* crosses into the impermissible zone lying to the inside of $R_2$. The narrower outline of the body of rail car 104, having an $\epsilon$ of zero, like 104*b*, and having the same length as 104*a*, yet remaining outside the $R_2$ boundary, is shown in dashed lines as 104*c*. As can be seen, 104*c* is narrower than 104*a*. That being the case, and $\epsilon$ being very small relative to ($L_1$+$L_2$), taking truck center 115 as a point of rotation, by similar triangles the swing out at articulation connection 26 between rail car units 102 and 104 moves the inside edge of the car at mid span between 115 and 117 radially outward relative to $R_1$, $R_2$ and $R_3$ a distance smaller than, but proportionate to, $\epsilon$. The net effect is that swing-out tends to permit a wider car than otherwise, or to permit a greater car length for the same width as previously used.

In summary, conceptually, placement of the articulation connection longitudinally outboard of the truck centers can be thought of in terms of the additional car length that can be obtained by having an overhang, without changing the width of the car. It can also be thought of in terms of the cantilever arm forcing the centerline of the adjacent car unit outward relative to the radius of curvature of the centerline of the track, such that the adjacent rail car body can be wider than it could be if the articulation were not cantilevered.

Further, although the various embodiments illustrated herein show articulated connectors mounted to overhang beyond the closest adjacent truck to obtain the full benefit of car length possible within a given car plate envelope, some of this benefit can be obtained from lesser longitudinal eccentricity between the truck center and the pivot center, since even a partial eccentricity will cause the inboard deck edge of the car having the male articulated connection portion to ride further toward the outside of the track than otherwise.

Figure 4B:
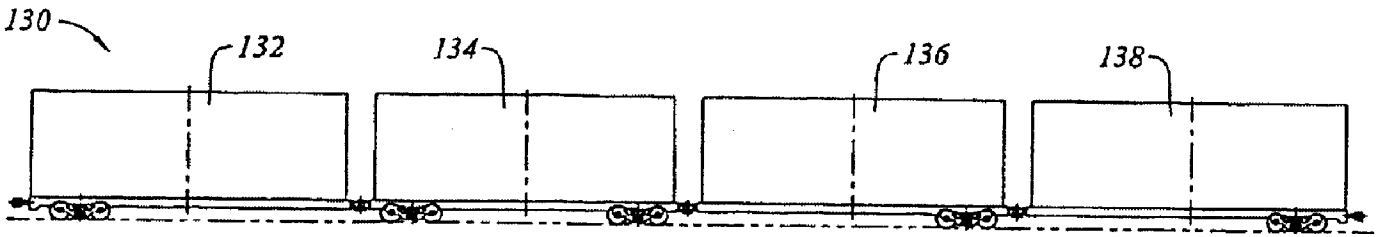
FIG. 4*b* shows a side view of an alternate four unit articulated rail road car to the articulated rail road car of FIG. 4*a;*
Figure 4C:
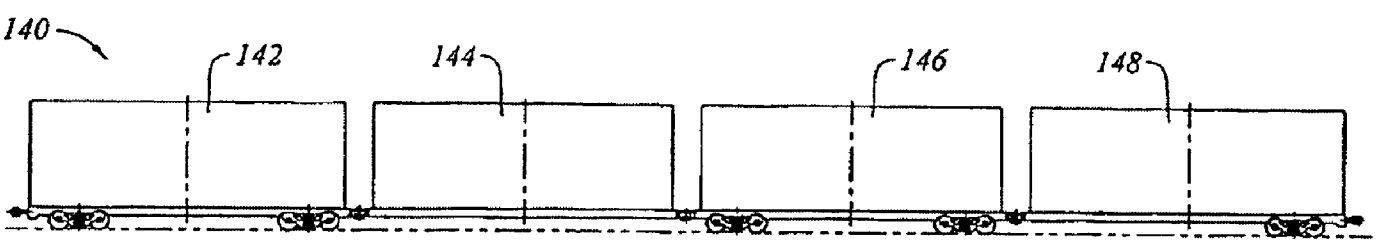
FIG. 4*c* shows a side view of another alternate four unit articulated rail road car to the articulated rail road car of FIG. 4*a;*
Figure 4D:
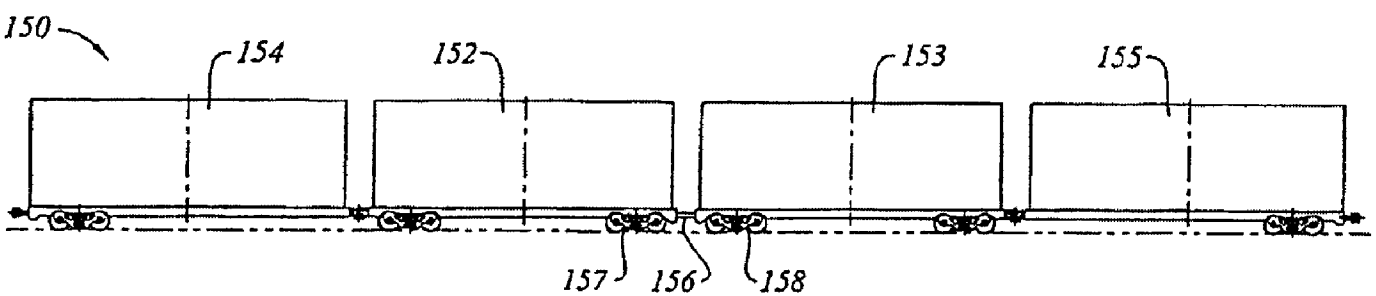
FIG. 4*d* shows a side view of a further alternate four unit articulated rail road car to the articulated rail road car of FIG. 4*a;*

The remaining multi-car embodiments shown in FIGS. 4*b* to 4*d* and 5*b* to 5*e* can be assembled from rail car units of the types described above. For example, the embodiment of FIG. 4*b* shows an articulated rail road car 130 that has a single-truck first end unit 132 that is the same as end unit 24; a two-truck intermediate rail car unit 134 that is the same as rail car unit 102; an intermediate single-truck unit 136 that is the same as unit 84, and a second single-truck end unit 138 that is the same as unit 24. FIG. 4*c* shows an articulated rail road car 140 that has a first two-truck end unit 142 that is the same as unit 82; a truckless intermediate unit 144 that is the same as truckless unit 122; a two truck intermediate unit 146 that is the same as unit 84; and a single truck end unit 148 that is the same as unit 24.

It is also possible to join adjacent rail car units with a combination of slackless draw bar connections and articulation connections. For example, in the embodiment of FIG. 4*d*, a partially articulated, partially draw-bar connected rail road car assembly 150 has a pair of two truck intermediate units 152 and 153 that are similar to unit 102, and a pair of single truck end units 154 and 155 that are similar to unit 24, but rather than having an articulated connection, units 152 and 153 are joined at their adjacent ends by a draw bar connection, indicated schematically as 156. Where a draw bar is used, there is 25 an adjacent rail car truck 157, 158 supporting the near end of each or the adjacent rail car units 152, 153 lying to either side of the draw bar. It would be possible, alternatively, to make a four-unit articulated rail road car by joining two pairs of rail road car units, such as 22 and 24, at the truck ends of their single truck rail car units, (i.e., 24) with a draw-bar in place of releasable coupler 47.

In FIG. 5*b*, an articulated rail road car 160 has an interior two-truck rail car unit 162 that is the same as unit 102, one single-truck end unit 164 connected to one end of unit 162, unit 164 being the same as unit 24; two intermediate units 166, 167 that are the same as unit 84, and a further single-truck end unit 168 that is the same as unit 24.

In the embodiment of FIG. 5*c*, an articulated rail road car 170 has an interior, middle two-truck unit 172 that is the same as unit 102, a pair of first and second oppositely oriented intermediate single-truck units 174, that are each the same as unit 84, and a pair of first and second single-truck end units 176 that are the same as unit 24. In the embodiment of FIG. 5*d*, an articulated rail road car 180 has an internal two-truck middle unit 182 that is the same as unit 102, a pair of two-truck end units 184 that are the same as unit 22, and a pair of intermediate truckless units 186 that are the same as unit 122. In the embodiment of FIG. 5*e*, an articulated rail road car 190 has a pair of first and second oppositely oriented single-truck end units 192 that are the same as unit 24, a pair of intermediate two-truck units 194 that are the same as unit 102, and a middle, truckless unit 196 that is the same as unit 122. Other combinations and permutations of these rail car units are possible.

Other multi-unit articulated rail road cars, or partially articulated rail road cars, having a larger number of rail car units can be assembled from the various types of rail car units noted above, whether one truck, two-truck, or truckless, and whether they are end units or intermediate units. In general, in each example there is an articulated rail road car having a plurality of rail car units, supported on a suitable number of rail car trucks to permit the articulated rail road car to roll in a longitudinal direction on rail road tracks. In each case there is at least one articulation connection lying between a pair of adjacent, first and second rail car units, the articulation connection being longitudinally cantilevered relative to the nearest of the rail car trucks. That is, none of the rail car trucks is mounted centrally under the cantilevered articulation connection.

Figure 6A:
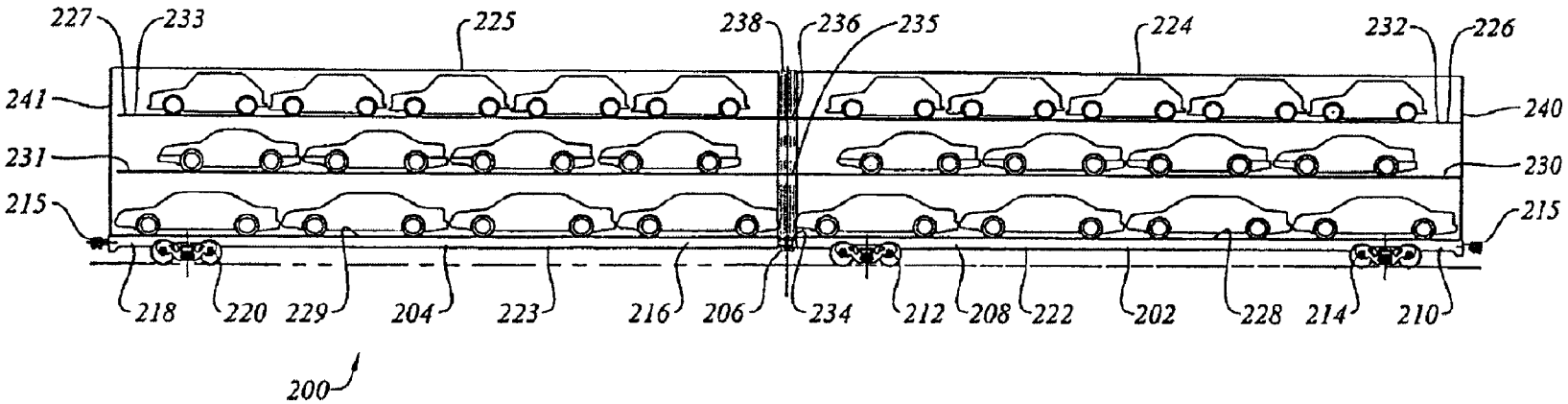
FIG. 6*a* shows a side view of a two unit articulated auto-rack rail car having the truck layout of the articulated rail road car of FIG. 2*a;*

FIG. 6*a* shows a two-unit articulated auto rack rail road car 200 that is similar to articulated rail road car 20 in layout. It has a two-truck first unit 202 and a single truck second rail car unit 204, joined at an articulation connection 206. Unit 202 has first and second end portions 208 and 210, each of which is mounted over a freely pivoting four wheeled truck 212, 214 respectively. First end portion 208 is proximate to connection 206, and second end portion 210 is distant from connection 206. Second end portion 210 has a conventional releasable coupler 215 mounted thereto for connection to other cars in interchangeable service.

Unit 204 has first and second end portions 216 and 218, end portion 216 being proximate to connection 206 and end portion 218 being distant therefrom. Unit 204 has a single freely pivoting four-wheeled truck 220 located under end portion 218. Second end portion 218 is substantially the same as second end portion 210, and, similarly, has a conventional releasable coupling 215 for interchangeable service. In this way, two-truck rail car unit 202 is a two-truck end unit, and rail car 204 is a single truck end unit.

Each of units 202 and 204 has a body 222, 223 having an upwardly extending enclosure structure for housing vehicles to be carried, such as automobiles, indicated generically as 224, 225. A decking structure 226, 227 is mounted within body 222, 223.

In the embodiment illustrated in FIG. 6*a*, decking structure 226, 227 is a triple deck structure that includes a flat main deck 228, 229, an upwardly spaced middle deck, 230, 231 and a further upwardly spaced upper, or top deck 232, 233. A spanning assembly in the nature of main, middle and top pairs of bridge plates 234, 235, 236 extend between decking structures 226 and 227 to permit longitudinal loading of vehicles from one car unit to the next in the manner known as circus loading. The gap between enclosure structures 224 and 225 is enclosed by a flexible structure in the nature of a bellows 238. The open ends of enclosure structures 224 and 225 and enclosed by moveable closure members in the nature of doors 240, 241, typically of the type often referred to as a "radial arm door" employing a monolithic door panel having a curved portion and a tangent portion and a radial arm extending from a point of rotation to the door panel. The doors are moveable between open positions for loading and discharging vehicles, to a closed position tending to keep out rain, snow, stones, vandals and thieves.

Figure 6B:
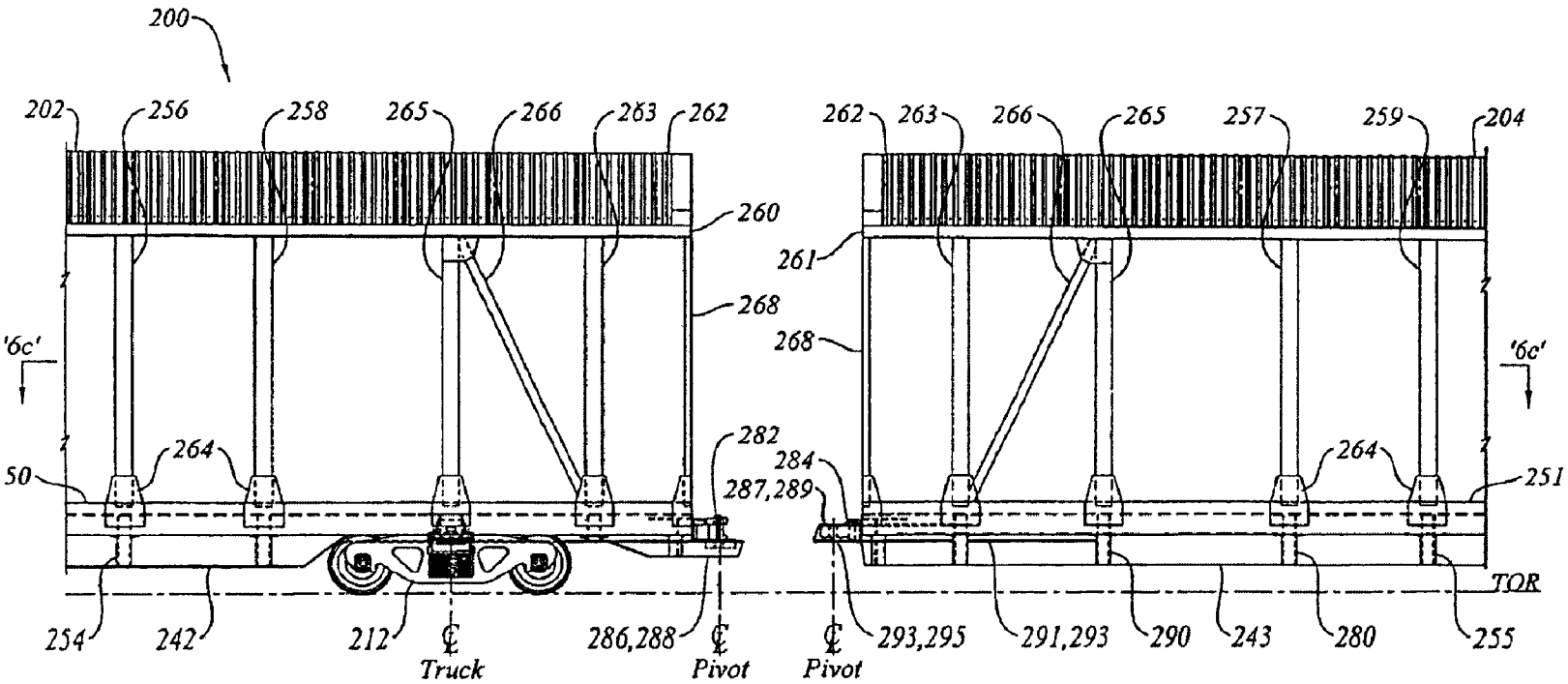
FIG. 6*b* shows a side view detail of the auto-rack rail road car of FIG. 6*a;*
Figure 6C:
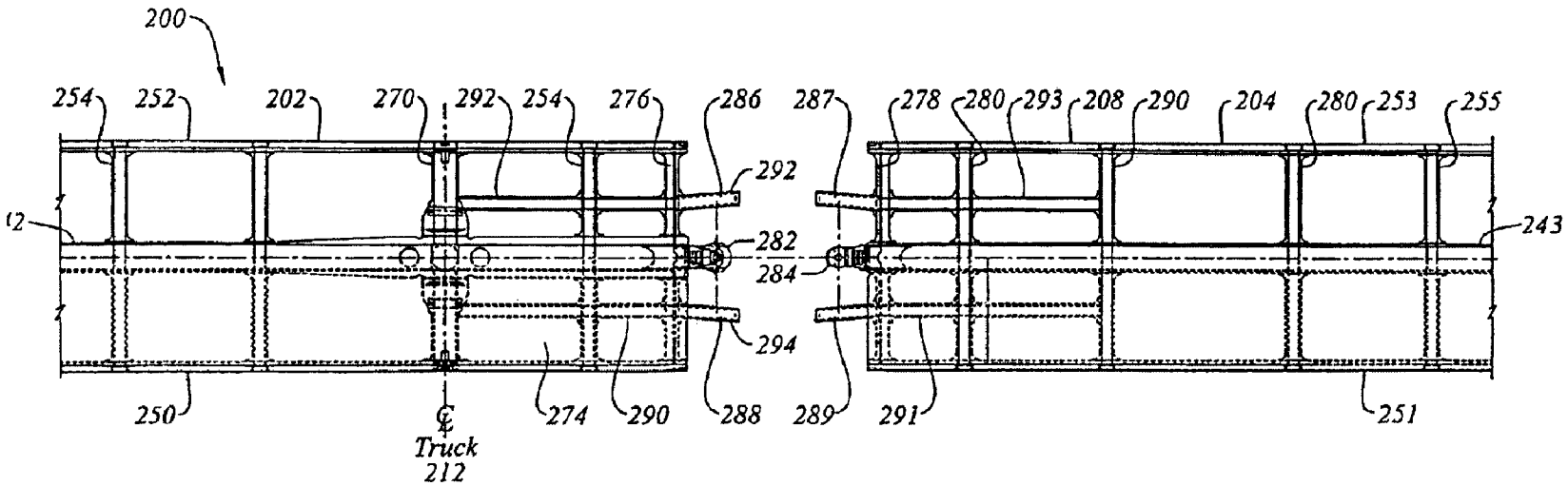
FIG. 6*c* shows a top view detail of the auto-rack rail road car of FIG. 6*a;*

Details of autorack rail car 200 of FIG. 6*a* are illustrated generally in FIGS. 6*b*, and 6*c*, with the upper and middle decks, bridge plates, bellows and side panels removed. Each of car units 202 and 204 has a main center sill 242, 243; a pair of left and right hand side sills 250, 252 and 251, 253; and an array of cross-bearers 254, 255 extending laterally between center sill 242, 243 and side sills 250, 252, 251, 253 at the longitudinal stations of an array 256, 257 of upright posts 258, 259.

Posts 258, 259 are, typically, on roughly 4 ft centers. Posts 258, 259 extend upwardly to a top chord member 260, 261, to which a roof canopy of transversely corrugated steel sheet 262 is mounted. Each of posts 258, 259 is provided with a gusset plate 264 to improve the moment connection to side sill 250, 252 or 251, 253, respectively. The last, or most longitudinally outboard of posts 258 or 259 is sometimes referred to as the "number 1" post indicated as 263, and the penultimate (i.e., second to last) post, namely the next longitudinally adjacent inboard post is referred to as the "number 2" post, indicated as 265. A diagonal brace 266 extends upwardly from the base of the "number 1" post 263 toward the juncture of the "number 2" post 265 with each respective top chord. An end post, 268, extends between the deck and canopy sheet 262 outboard of "number 1" post 263.

Car unit 202 has a laterally extending main bolster 270 mounted at the longitudinal location of the truck center of truck 212, such that the laterally outboard distal extremities of main bolster 270 meet side sills 250, 252 at the longitudinal station of the root of the "number 2" post, 265. An endmost lateral structural member in the nature of an end bolster 272 extends laterally outboard from main center sill 242 to meet the ends of side sills 250 and 252. (In this, or other, examples, the endmost lateral structural member can be either an end bolster or an end sill, or other suitable cross-member). A main deck shear plate 274 is mounted upon the upper flanges of main center sill 250, main bolster 270, end bolster 276 and cross-bearers 254 and extends laterally between side sills 250, 252. At the longitudinally outboard end portion 210 of car unit 202, that is, the end furthest from articulated connection 206, rail road car 200 has a similar underframe construction of main bolster, end bolster and cross-bearers and shear plate. It differs in having a conventional draft sill and releasable coupler 215 for interchangeable service connection with other rail road cars.

The upper portion of FIG. 6*b* is shown with the respective shear plates removed to reveal the underlying bolster structure.

Rail car unit 204 has a conventional underframe structure at its longitudinally outboard end portion, 218, with main bolster, end bolster, cross bearers, shear plate, draft sill and interchangeable coupler in the same manner as end 210 of unit 202. At the inboard end portion 208 of car unit 204, the underframe structure differs in having merely an end bolster 278, and cross-bearers 280, but no main bolster, and a straight through main sill end of constant section to the end bolster, there being no truck to be accommodated.

A female articulated connector portion 282 is mounted to the end of center sill 242 of car unit 202. A male articulated connector portion 284 is mounted to the inboard end of main center sill 243 of rail car unit 204, portions 282 and 284 being designed to mate and to be held together with appropriate bearing surfaces and a pin, such as described above. Female articulated connector portion, 282, is bracketed by a pair of left and right hand female side-bearing arms 286, 288. Arms 286 and 288 are splayed outwardly. Longitudinal structural reinforcement members, in the nature of a pair of first and second left and right hand beams 290, 292 are carried longitudinally inboard from the root of arms 286 and 288, to terminate at main bolster 270.

Male articulated connector portion 284 is bracketed by a pair of left and right hand male side bearing arms 287 and 289. Arms 287 and 289 are splayed outwardly. Longitudinal structural reinforcement members, in the nature of a pair of first and second, left and right hand beams 291, 293 are carried longitudinally inboard from the root of arms 287 and 289, to terminate at the second inboard cross-bearer located at the longitudinal station of the "number 2" post 265, indicated as 290.

Side bearing arms 286, 288, and 287, 289 engage in the manner of side bearing arms generally, with female arms 286 and 288 having upwardly facing bearing surfaces 292, 294, and male side bearing arms 287, 289 having downwardly facing bearing surfaces 293, 295. The arrangement of the male and female bearing surfaces could be reversed. However, in operation this reversal could tend to increase the vertical reaction carried in the female portion 282 of articulated connector 286, whereas the arrangement shown would tend not to.

Figure 6D:
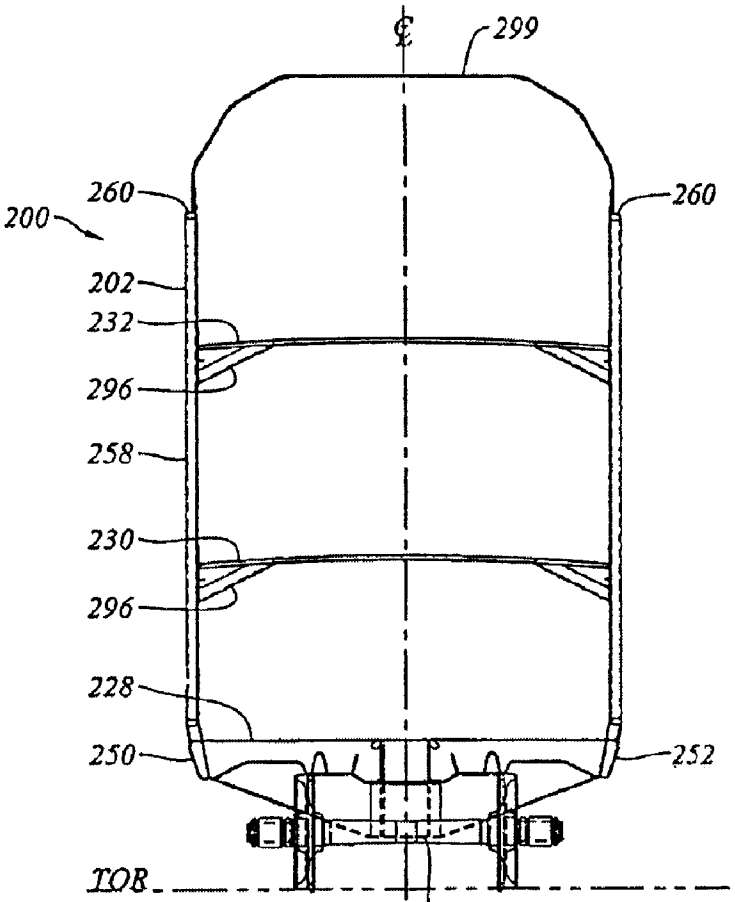
FIG. 6*d* shows a cross-section at the main bolster of the auto rack rail road car of FIG. 6*a;*
Figure 6E:
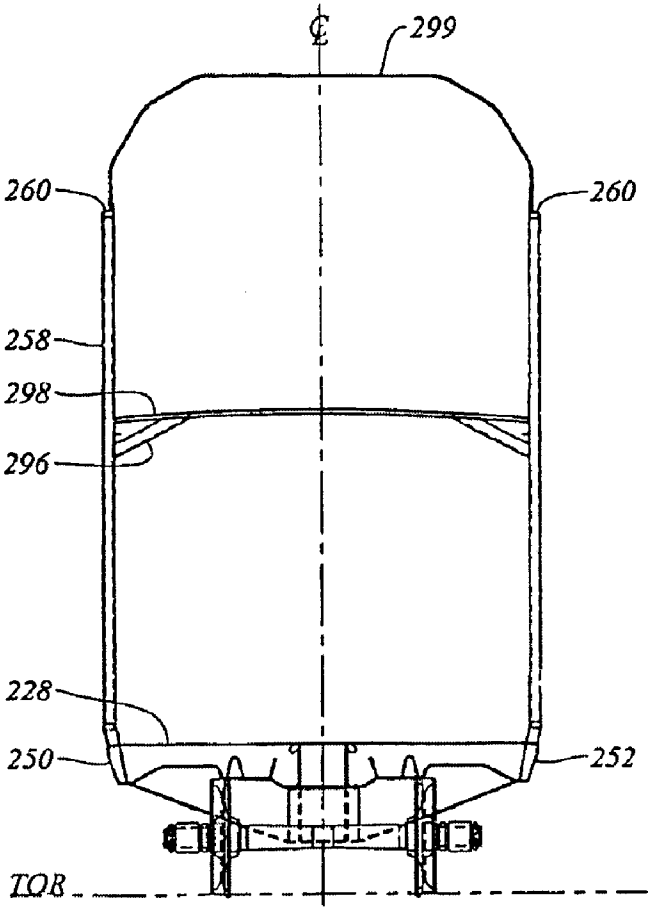
FIG. 6*e* shows an alternate cross-sectional view to that of FIG. 6*d;*

FIG. 6*d* shows a cross-section of car unit 202 at the truck center of truck 212, and shows a tri-level configuration of main, middle and upper decks 228, 230 and 232 for carrying automotive vehicles. Each of the middle and upper decks has a slight crown, and has knee braces 296 mounted to posts 258. FIG. 6*e* shows a similar cross section of an alternative car unit in a bi-level configuration, with a main deck 228 and an upper deck 298. A thin-shelled corrugated steel roof structure 299 is shown mounted to span the width of car unit 202 above the decks between the top chords.

Figure 6F:
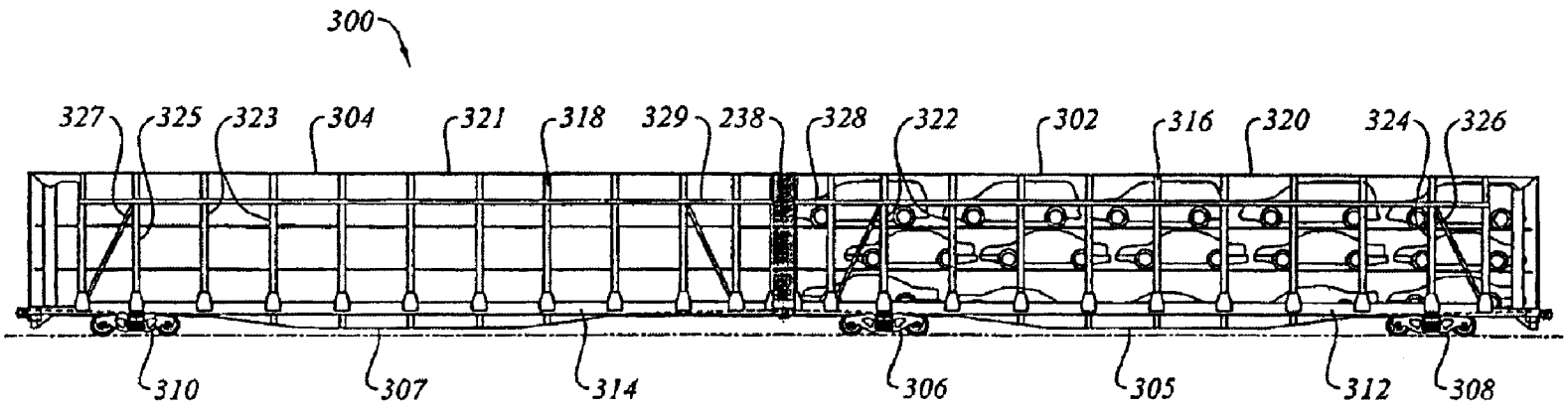
FIG. 6*f* shows an alternate two unit articulated autorack rail road car to that of FIG. 6*a*, the rail car units thereof having depressed center portions.

In the alternative embodiment of FIG. 6*f*, another two unit, articulated auto-rack rail road car is indicated as 300. It has first and second units 302 and 304 that are broadly similar to units 202 and 204, but differs from them in having wells 305, 307 located inboard of trucks 306, 308 and 310 between respective pairs of side sills 312, 314, rather than a flat main deck. The body of each of units 302 and 304 employs a truss structure 316, 318 having a substructure that includes side sills 312, 314, a superstructure that includes an overhead framework 320, 321 having transverse frames and longitudinal stringers, and an intermediate shear force transfer assembly in the nature of pairs of laterally spaced side webworks 322, 323. Each of side webworks 322, 323 includes an array of posts 324, 325 and diagonal bracing 326, 327. Side web works 322, 323 extend vertically between side between the substructure and a pair of top chord members 328, 329. The transverse frames of overhead framework 320, 321 are mounted on top chord members 326 at the longitudinal stations of posts 324. In this way the superstructure, substructure, and intermediate shear force transfer assemblies co-operate, and tend to function in the manner of a box truss.

In further alternative embodiments, units 202 and 204 could be made using a similar truss construction to units 302 and 304, or, conversely, units 302 and 304 could be fabricated with a thin-shelled roof structure as shown in FIGS. 6*b*, 6*d* and 6*e*.

Inasmuch as the cross-section of autorack rail car units 202 and 204 is the same at mid span, a car unit having two trucks, and articulation connections at each end can be manufactured by using two end portions 208, as shown in FIG. 6*b*, 6*c* mounted to form a single body. Alternatively, a truckless car unit can be manufactured using two truckless end portions, such as end portion 216, in a single body, and an internal single truck car unit can be manufactured using an end portion such as end portion 208 of unit 202 and an end portion such as end portion 216 of unit 204, mounted together to form a single body. In this way, a variety of types of car can be produced to yield the various strings of cars units described below.

Figure 7A:
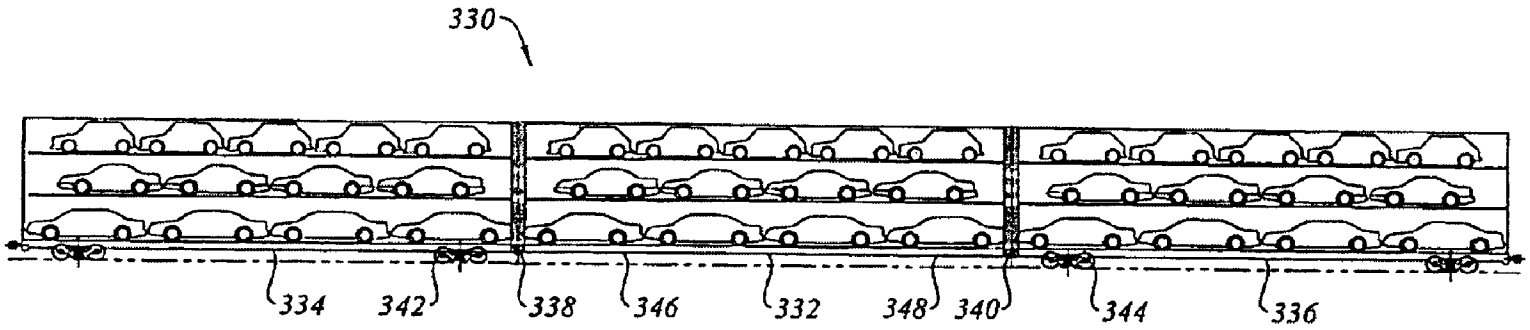
FIG. 7*a* shows a side view of a three unit articulated auto-rack rail road car having the truck layout of the articulated rail road car of FIG. 3*c;*

FIG. 7*a* shows a three-pack articulated auto rack rail road car 330 having the same general layout as articulated rail road car 80 of FIG. 3*b*. Rail road car 330 has a truckless middle unit 332 and a pair of two-truck end units 334 and 336. Each of end units 334 and 336 has the same construction as unit 202 of articulated rail road car 200 described above. Unit 332 however, is truckless. That is, unit 332 is supported at either end at articulation connections 338 and 340, but is not otherwise supported by any truck between trucks 342 and 344 of units 334 and 336. Conceptually, unit 332 can be thought of as having two end portions 346 and 348, each of which is like end portion 216 of car unit 204, joined together.

Figure 7B:
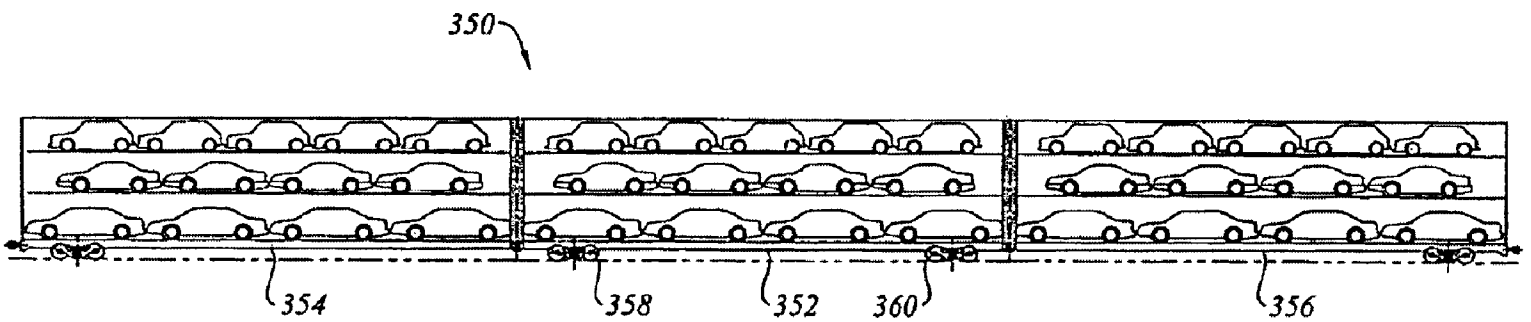
FIG. 7*b* shows a side view of an alternate three unit rail road car to FIG. 7*a;*

FIG. 7*b* shows a three-pack articulated auto-rack rail road car 350 that has the same general layout as articulated rail road car 100 of FIG. 3*a*. That is, it has a two-truck middle unit 352, and a pair of single truck end units 354 and 356. Each of units 354 and 356 has the same construction as auto-rack rail car unit 204. Rail car unit 352 has a pair of freely pivoting trucks 358 and 360 and articulated connectors at both ends. The general construction of car units 352,354 and 356 is as described above for car units 202 and 204.

Rail road car 350 shows the preferred truck layout of the present invention—that is, an articulated three pack auto rack rail road car with a two truck middle unit, with single truck end units to either side, and cantilevered articulated connectors lying outboard of the respective trucks of the middle car unit. Although the rail road cars of FIGS. 7*a*, 7*b*, 8*a* and 8*b* are shown in tri-level configuration, it will be understood that they can be made in either bi-level configuration, or tri-level configuration, or with movable decks convertible between bi-level and tri-level configurations. In the preferred embodiment, the decks are fixed, and in bi-level configuration as shown in FIG. 6*e*. In the preferred embodiment, in bi-level configuration, the spacing between the truck centers of the two-truck middle car unit is 57 ft. 9 in., that is, a distance greater than the base car truck center distance of 46 ft. 3 in. The distance from the nearest truck center to the articulated connector is 12 ft. 1 in. The distance between the articulated connectors is then 81 ft. 11 in. The distance from the articulated connection to the adjacent single end unit truck at either end is 69 ft. 10 in. with a 14 ft. 1 in. overhang to the striker face. The overall length of the three pack is 249 ft 9 in., such that a pair of three pack cars coupled together yields a nominal design length of 499 ft 6 in. An example of dimensions for a corresponding tri-level three-pack auto rack rail car are 55'-0" truck centers for the two truck middle car unit; truck to articulation, 8 ft, 3.5 in.; between articulations 71 ft. 7 in.; from the articulations to the single end unit trucks is 58 ft. 6 in.; the end unit overhang is 13 ft. 7-¾ in.; and the overall tri-level three pack length is approximately 218 ft.

Figure 8A:
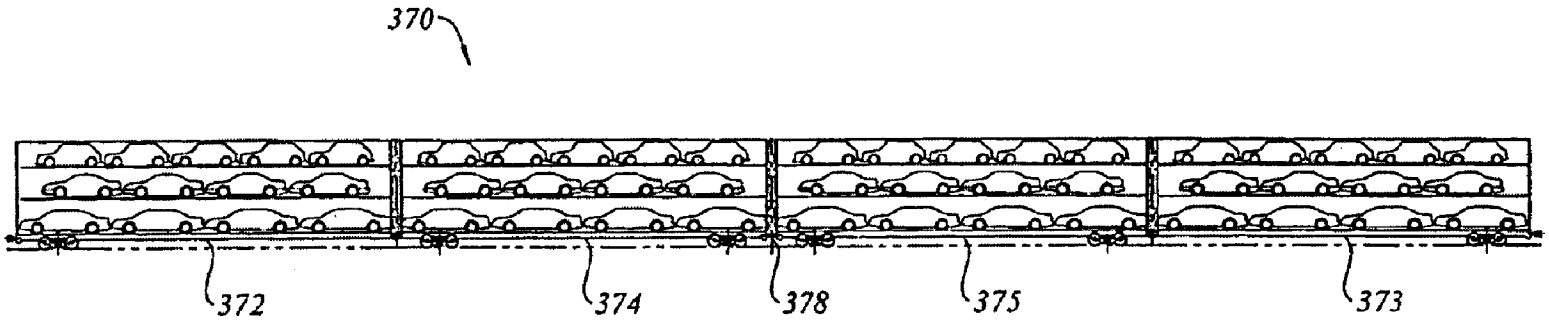
FIG. 8*a* shows a side view of a four unit articulated rail road car analogous to the two unit articulated rail road car of FIG. 6*a;*

FIG. 8*a* shows a four unit articulated auto-rack car 370. It has individual single truck rail car end units 372, 373, and internal double truck rail car units 374, 375. End car units 372 and 373 have the same layout and construction as car unit 204 of FIG. 6*a*. Internal car units 374 and 375 have the same general construction as car unit 202 of FIG. 6*a*, but rather than having a releasable coupler at the end remote from their respective single truck adjacent units, car units 374 and 375 are connected at their common end by a slackless draw bar 378.

Figure 8B:
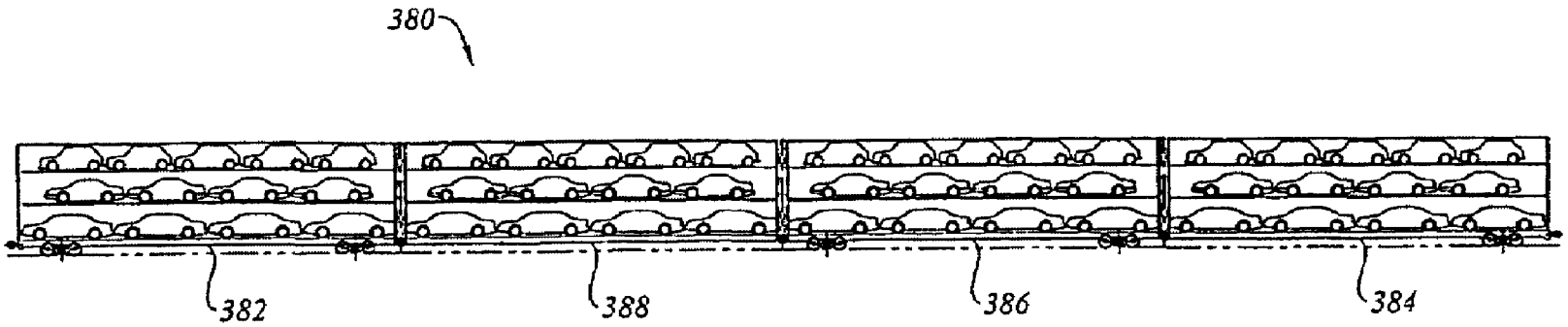
FIG. 8*b* shows a side view of an alternate four unit articulated rail road car to the articulated rail road car of FIG. 8*a;*

FIG. 8*b* shows another four unit articulated auto-rack rail road car, 380. It has a two truck end rail car unit 382 of the same construction as two truck end unit 202 of FIG. 6*a*; a single truck end unit 384 that has the same construction as single truck end unit 204, a two truck intermediate unit 386 that has the same construction as middle unit 352, and a truckless intermediate unit 388 that has the same construction as middle unit 302, described above.

The end portions of the car units shown in FIGS. 6*a* to 6*f*, 7*a* and 7*b* and described herein can be assembled to produce single truck rail car end units, single truck intermediate rail car units, truckless intermediate units, two truck intermediate units, and two truck end units. In that light, the car units described can be assembled and arranged to produce many other combinations of rail road cars having cantilevered articulations, whether 2, 3, 4, 5, 6, 7 or more units in an articulated rail road car, including auto rack rail road cars corresponding to each of the examples of FIGS. 2*a* to 5*e*. Further, the general construction of either the units of rail road car 200 or of rail road car 300 can be employed. In addition, although the above description applies to multi-level auto-rack cars, it can also be applied to single deck articulated rail road cars for carrying vehicles. A single deck articulated rail road car, without side wall structures, and without an overhead roof structure can also be constructed, such as for carrying larger vehicles, highway trailers or other intermodal cargo.

FIGS. 9*a*, 9*b*, 9*c* and 9*d* show abridged top and side views of two units of an articulated well car 400 such as may be employed for transporting intermodal containers or highway trailers, or a combination of containers and highway trailers. FIGS. 9*a*, 9*b*, 9*c* and 9*d* have been abridged to omit the central portions of the units of car 400, so that the end portions may be shown in a larger proportion. The views are truncated longitudinally inboard of the first container support cross-member, the cross-section of the car between those cross-members being constant, with transverse cross-members spaced longitudinally to provide support for the various containers support pedestals or cones, or highway trailer rear wheel sets as required conventionally.

Rail road car 400 has a first end unit 402, and a second end unit 404, joined at an articulated connection 406 that has a first, or female portion 408 mounted to first end unit 402, and a second, or male portion 410 mounted to second end unit 404. Portions 408 and 410 engage, and when mated, are held together by a nominally vertical pin, as noted above.

First end unit 402 is a two-truck end unit, having a first end portion 412 proximate to articulation connection 406, and a second end portion 414 distant from connection 406. A first, freely pivoting two axle rail car truck 416 is mounted under second end portion 414. Another freely pivoting two axle rail car truck and 418 is mounted under first end portion 412 Inboard truck 418 has larger wheels, and a larger carrying capacity, than outboard truck 416. That is, outboard truck 416 has 33 inch diameter wheels. Inboard truck 418 has 38 inch wheels.

The distal end, that is, the longitudinally outboard end of portion 414 carries a standard releasable coupling (not shown) for connection with the couplers of other rail cars in interchange service.

Rail car unit 402 has structural longitudinal central beam members in the nature of a first, outboard stub center sill 420, and a second, inboard stub sill 422. It also has transverse structural members in the nature of a first, outboard main bolster 424 (shown in hidden lines) extending perpendicularly laterally from outboard stub sill 420 at the longitudinal location of the truck center of outboard truck 416; an inboard main bolster 426 extending laterally perpendicular to inboard stub sill 422 at the location of the truck center of inboard truck 418;

a first end bolster 428 located parallel to, and longitudinally outboard of, first main bolster 424; a second end bolster 430 located parallel to, and longitudinally outboard of second main bolster 426 (that is, toward articulation connection 406). A pair of laterally spaced, deep side sills 432 and 434 extend the length of rail car unit 402 between end bolsters 428 and 430, and mate also with the outboard ends of the wings of main bolsters 424 and 426. Outboard stub center sill 420 has an inboard termination at a transverse bulkhead 436 that extends between side sills 432 and 434. Similarly inboard stub center sill 422 has an inboard termination at a transverse bulkhead 438, also extending between side sills 432 and 434.

It can thus be seen that a well 440 is defined between side sills 432 and 434, and longitudinally between bulkheads 436 and 438. Well 440 is provided with cross members 442 extending between side sills 432 and 440, the cross members having container supports members or pedestals 444. Floor pans 446 are also provided for supporting the wheel sets of highway trailers, as may be required.

A pair of pin-jointed diagonal load spreading beams 448 and 450 extend between a footing 452 whence loads are passed to and from stub center sill 420, to inboard terminations mounted to first cross beam 454. A shear plate 456 overlies the cruciate form of stub center sill 420 and main bolster 424 and extends to side sills 432 and 434. A hitch mounting, to which a highway trailer hitch plate can be pivotally affixed is shown as 456. Hitch mounting 456 is located over the longitudinal centerline of unit 402, at the longitudinal station of main bolster 420.

Similarly, at the far end of well 440, a pair of pin-jointed diagonal load spreading beams 449 and 451 extend between a footing 453 whence loads are passed to and from inboard stub center sill 422, to inboard terminations mounted to first cross beam 455. A shear plate 457 overlies the cruciate form of stub center sill 422 and main bolster 426 and extends to side sills 432 and 434. A hitch mounting, to which a highway trailer hitch plate can be pivotally affixed is shown as 459. Hitch mounting 459 is located over the longitudinal centerline of unit 402, over main bolster 422. portion 406 Reinforcements, that is, a pair of longitudinally extending stiffening members in the nature of steel beams 484 and 486, are mounted intermediate stub center sill 426 and side sills 432 and 434, respectively, such that they mate with end bolster 430 at the lateral station corresponding to the root of each of side bearing arms 480, 482. Beams 484, 486 run inwardly to terminate at main bolster 426. Gussets are located opposite the webs of beams 484, 486 to provide web continuity at the junctions with main bolster 424 and end bolster 428. It will be noted that side bearing arms 480, 482 have bearing surfaces 490, 492 that face upwardly. A brake valve mounting bracket 494 extends from side bearing arm 492.

Figure 9A:
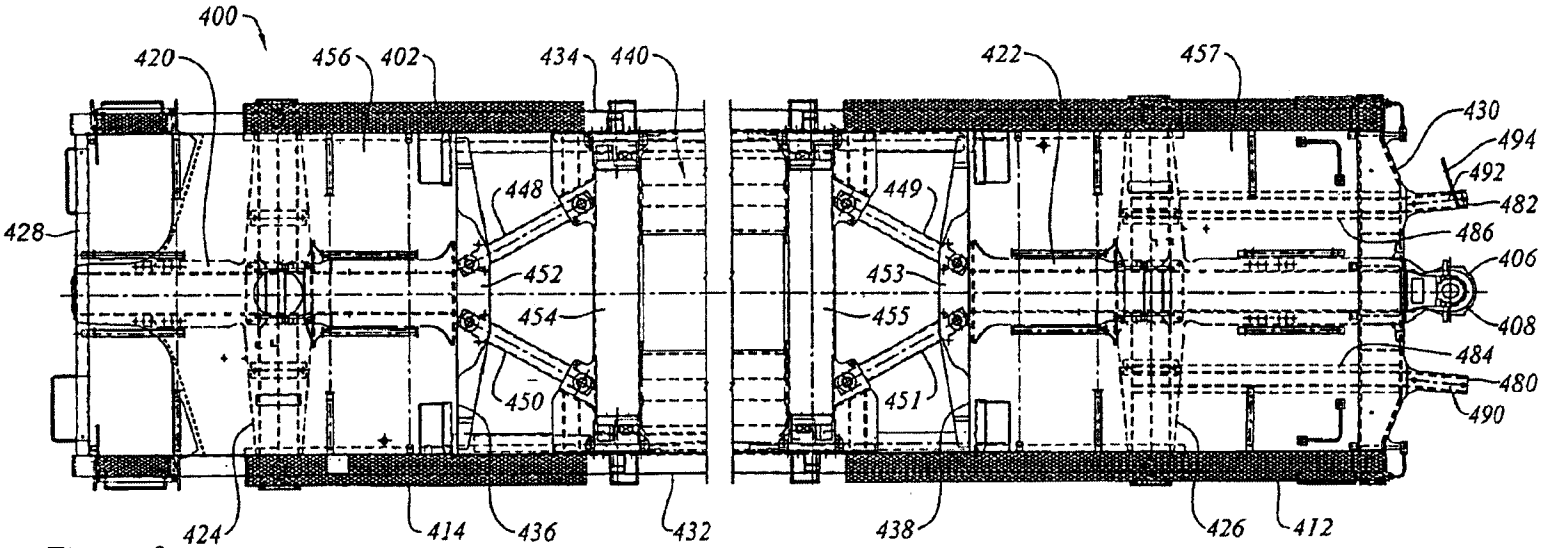
FIG. 9*a* shows a shortened top view of an articulated well car end unit analogous to an end unit of the two unit articulated rail road car of FIG. 2*a;*
Figure 9B:
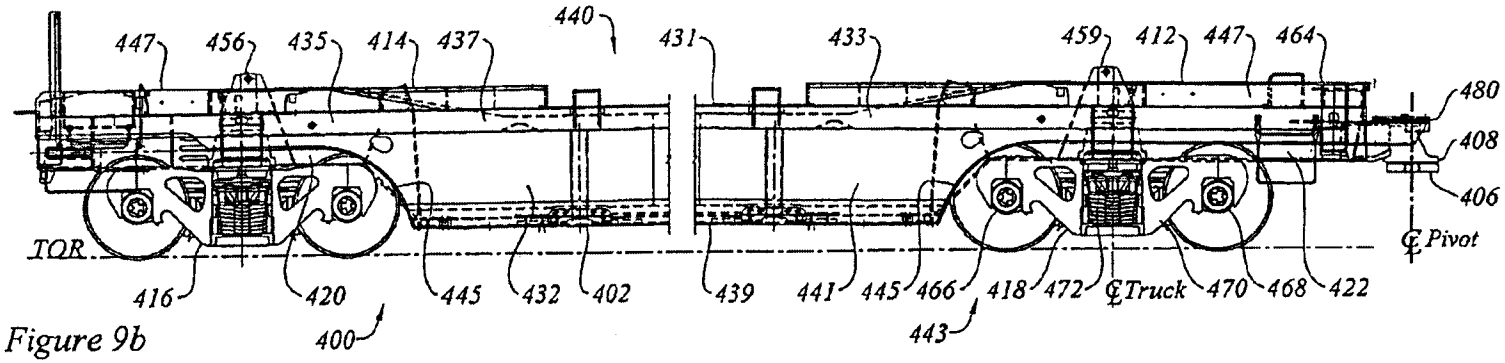
FIG. 9*b* shows a shortened side view of the articulated well car end unit of FIG. 9*a;*
Figure 9C:
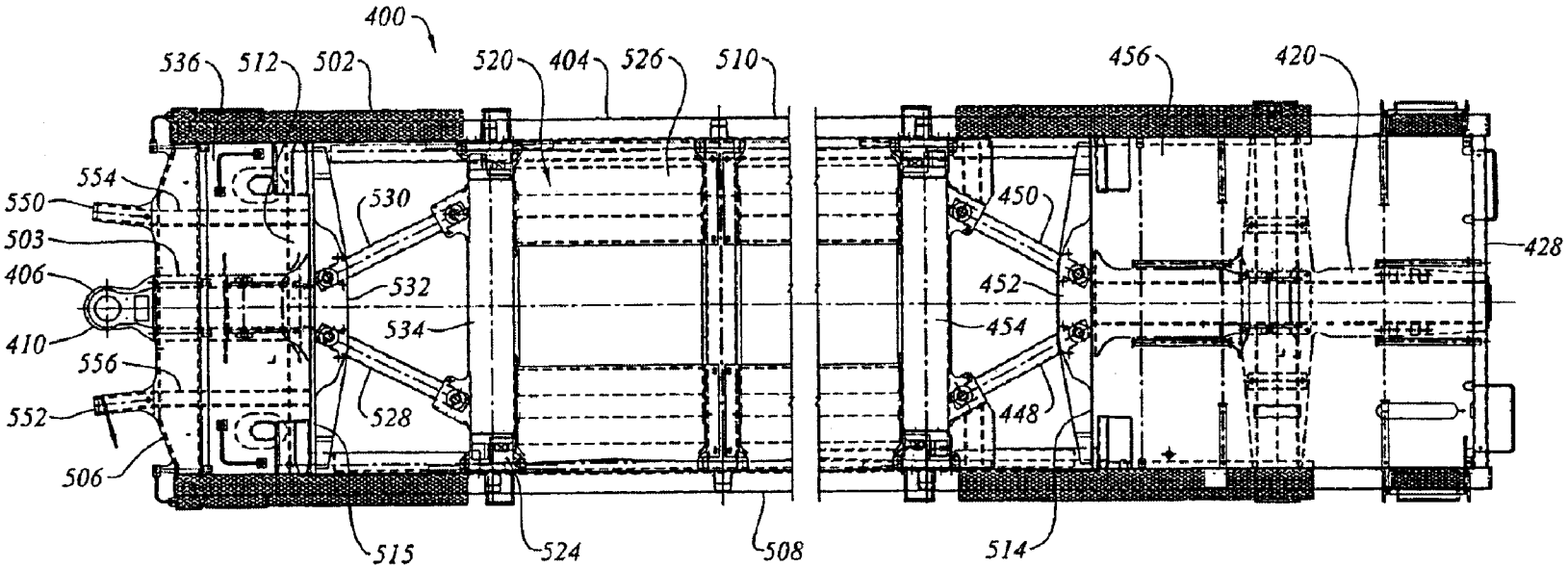
FIG. 9*c* shows a shortened view of a mating articulated well car end unit to the end unit of FIG. 9*a*.
Figure 9D:
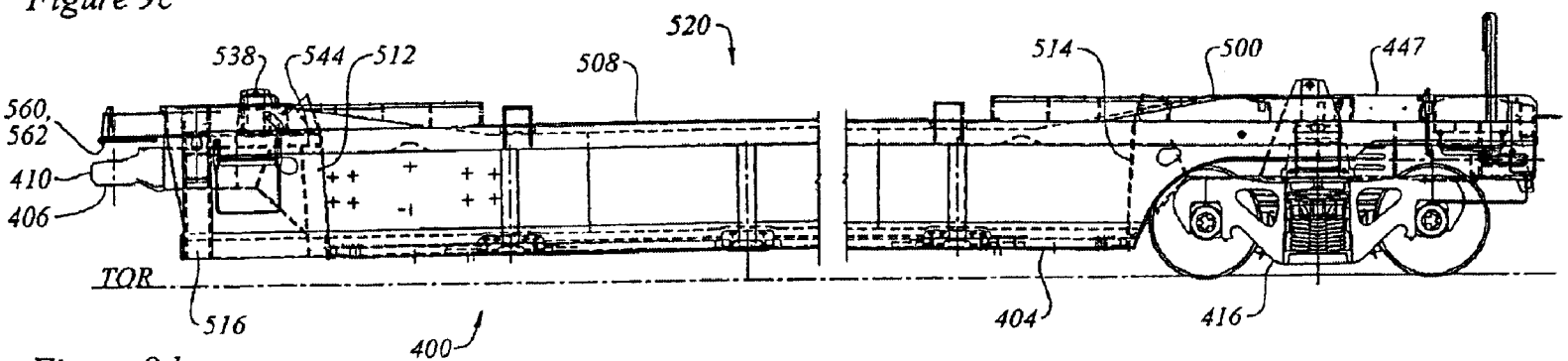
FIG. 9*d* shows a side view of the shortened end unit of FIG. 9*c*.

Car unit 404 is shown in FIGS. 9*c* and 9*d* in abridged top and side views. Car unit 404 has a distal end portion 500 located away from articulated connection 406, and a proximal end portion 502 to which male articulated connector portion 410 is mounted Distal end portion 500 is substantially identical to distal end portion 420 of first rail car unit 402, described above, the same item numbers being used to identify the various components.

Proximate end portion 502 is significantly different in construction to end portion 412 of unit portion 402. End portion 502 has a main structural longitudinal central beam member in the nature of a first, inboard stub center sill 503. End portion 502 has transverse structural members in the nature of an end bolster 506 located at the end of stub sill 503 immediately adjacent male articulated connector portion 410 and running laterally outboard to side sills 508 and 510; and a second inboard end bolster cross-member, or bolster 512 located parallel to, and longitudinally inboard of, end bolster 506 (that is, in a longitudinal direction away from articulation connection 406). Inasmuch as unit 404 does not have a truck at proximal end portion 502, it does not have a main bolster with a fitting to mate with a truck. It also does not have a wheel well, or side sill rebate. Rather, side sills 508 and 510 continue at full depth to a vertical corner post 516. Stub center sill 503 has an inboard termination at a transverse bulkhead 515 that extends between side sills 508 and 510.

It can thus be seen that a well 520 is defined between side sills 508 and 510, and longitudinally between bulkheads 516 and 515. Well 520 is provided with cross members 522 extending between side sills 508 and 510, the cross members having container supports members 424. Floor pans 426 are also provided for supporting the wheel sets of highway trailers, as may be required.

As described above in the context of rail car unit 402, a pair of pin-jointed diagonal load spreading beams 528 and 530 extend between a footing 532 whence loads are passed to Each of side sills 432 and 434 has a middle portion 431 of constant depth, and end portions 433 and 435 of reduced depth to clear the respective trucks. The top chord member 437 of each of side sills 432, 434 is carried through the full length of the car. The bottom chord member 439, and the web member 441 connecting top chord member 437 and bottom chord member 439, are both cut short to accommodate the trucks, 416 and 418. The wheel rebate 443 so formed is bordered by an upswept flange, or fender 445 that sweeps upwardly on a curve from bottom chord 439 at the end of middle portion 431. A tapered hollow longitudinal reinforcement beam 447 is mounted above, and runs along, each of top chord members 437 between the respective end bolster and well 440, giving a greater depth of section to end portions 433 and 435

The end portion 414 of rail car unit 402 is constructed in the manner of a rail car termination end for interchangeable connection with other railroad cars generally. By contrast, end portion 412 of rail car unit 402 is an internal end to which an articulated connector portion, namely female articulated connector portion 470 is mounted. Female articulated connector portion 470 is mounted in a pocket formed between the upstanding side webs, and the bottom flanges of the longitudinally outboard extending end of stub center sill 420, and a false flange, or web, welded inside center sill 420 below the level of shear plate 457.

As shown in the side view of FIG. 9*b*, center sill 420, side sills 432 and 434, and shear plate 457 all extend longitudinally outboard of the longitudinal station of the truck center CL—Truck of truck 418, such that there is a cantilevered overhang, indicated generally as 464, to which the connection means, namely female connection portion 460 is welded. Truck 418 has an inboard axle 466, an outboard axle 468, side frames 470, and a truck bolster 472 that lies under main bolster 426. As can be seen in FIG. 9*b*, the center pin axis CL—Pivot, defining the location from which articulation connection 406 is measured, is located outboard of the distal extremity of overhang 464. The longitudinal offset is the distance between CL—Pivot and CL—Truck. Not only is the pivot centerline, and hence connection 406 longitudinally eccentric relative to the truck center, but it is cantilevered outboard a distance lying beyond the axis of outboard axle 468, lies fully outboard of truck 416 generally, and lies outboard of the endmost lateral structural member, namely end bolster 430, as well.

A pair of inverted side bearing arms 480 and 482 are mounted to, and extend longitudinally outboard from, end bolster 430 to bracket female articulated connection and from stub center sill 503, to inboard terminations mounted to first cross beam 534. A shear plate 536 overlies the H-shaped form of stub center sill 503, end bolster 506 and inboard bolster 512, and extends to side sills 508 and 510. A hitch mounting, to which a highway trailer hitch plate can be pivotally affixed is shown as 538. Hitch mounting 538 is located over the longitudinal centerline of unit 404, between bolsters 506 and 512.

In summary, the end portion 500 of rail car unit 404 is constructed in the manner of an external rail car termination end for interchangeable connection with other railroad cars generally. By contrast, end portion 502 of rail car unit 404 is an internal end to which an articulated connector portion, namely male articulated connector portion 410 is mounted. Male articulated connector portion 410 is mounted in a pocket formed between the upstanding side webs, and the bottom flanges of the longitudinally outboard extending end of stub center sill 503, and a false flange, or web, 544 welded inside center sill 503 below the level of shear plate 546.

A pair of side bearing arms 550 and 552 are mounted to, and extend longitudinally outboard from, end bolster 506 to bracket male articulated connection portion 410. Reinforcements, that is, a pair of longitudinally extending stiffening members in the nature of steel beams 554 and 556, are mounted intermediate center sill 503 and side sills 508 and 510, respectively, such that they mate with end bolster 506 at the lateral station corresponding to the root of each of side bearing arms 550 and 552. Beams 554 and 556 run inwardly to terminate at bolster 512. Gussets are located opposite the webs of beams 554 and 556 to provide web continuity at the junctions with bolster 512 and end bolster 506. It will be noted that side bearing arms 550 and 552 has bearing surfaces 560 and 562 that face downwardly to permit engagement with the upwardly facing bearing surfaces 490 and 492 of unit 402 when articulated connector portions 408 and 410 are engaged and car 400 is operated on a bend.

When male portion 410 engages female portion 408, a vertical shear load from unit 404 is transferred to the cantilever formed by stub sill 420, and the associated overhanging end structure 464 of unit 402. The vertical reaction to this force is provided by truck 418 acting through second main bolster 426 of unit 402. The bending moment in sill 422 at the truck center location of truck 418 is balanced by the weight of car unit 402 lying toward truck 416.

Although end portion 502 of unit 404 does not have a truck, and although male articulated connector portion 540 is not supported directly over a truck, and although side bearing arms 560 and 562 are not reacted by side bearing arm pedestals mounted on a truck, but rather by side bearing arms 490 and 492, vertical weight tends to be carried by the female articulated connector portion 408 in the same manner as if it were carried above an articulated truck. That is, from the male side of the connection, the load transfer may tend to appear to be unchanged.

Although rail car unit 404 is shown as a single unit end truck, having a single internal male articulated connector portion at the unsupported internal end (namely end 502), and rail car unit 402 is shown as a single unit two-truck end unit having a single internal female end, other combinations are possible. For example, as suggested by the foreshortening abridgement section of FIGS. 9*a*, 9*b*, 9*c* and 9*d*, two internal male ends, such as end portion 502, can be assembled to yield a truckless car supported only at the permanent male articulated connector fittings at either end of the car. Such an internal car could be used as the middle car in the embodiment of FIG. 3*c*, for example. Similarly, an internal car with female articulated connector portions can be made by assembling two ends such as proximate end portion 412 of FIGS. 9*a* and 9*b*. Such a car can be used as the middle car unit in a layout such as described in FIG. 3*b*. Thirdly, a single truck intermediate car unit can be manufactured by combining the proximate end portion 502 of car unit 404 with the proximate end portion 412 of car unit 402. In this way, all of the combinations of layout noted above can be assembled using combinations of the end portions shown and described in FIGS. 9*a*, 9*b*, 9*c* and 9*d*. In this way the construction shown and described permits the manufacture of the sets and combinations of layout of articulated rail road cars shown in FIGS. 2*a* to 5*e*. It will also be noted that flat cars, or auto-rack cars, or box cars, or other types of cars can be assembled using the same type of construction as described in FIGS. 9*a*, 9*b*, 9*c* and 9*d*.

Various embodiments of the invention have now been described in detail. Since changes in and or additions to the above-described embodiments may be made without departing from the nature, spirit or scope of the invention, the invention is not to be limited to those specific embodiments.

I claim:

1. An articulated rail road car having a plurality of rail car units carried on a plurality of pivotally mounted rail car trucks, each said truck having spaced apart axles, said rail road car having releasable couplers at either end thereof for connection to other railroad cars, and a rolling direction defining a longitudinal direction, said plurality of rail car units including a first rail car unit and a second rail car unit connected together at an articulation connection, said rail car trucks including a first one of said rail car trucks located closer to said articulation connection than any other of said rail car trucks, said first rail car truck being pivotally mounted to said first rail car unit, said articulation connection being longitudinally eccentrically mounted relative to said first truck; and said articulation connection being operable to pass a vertical shear load from said second rail car unit to said first rail car unit.

2. The articulated rail road car of claim 1 wherein said first truck is a two axle truck mounted to pivot about a vertical truck center axis relative to said first car unit, and said articulation connection is cantilevered longitudinally relative to the truck center axis.

3. An articulated rail road car as claimed in claim 1 wherein said first and second rail car units have mutually engaging side bearing arms.

4. The articulated rail road car of claim 1 wherein said articulation connection has a first portion mounted to said first rail car unit, and a mating second portion mounted to said second rail car unit, said first and second portions meeting on a bearing interface defining a portion of a spherical surface.

5. The articulated rail road car of claim 4 wherein said articulation connection has a first portion mounted to said first rail car unit, and a mating second portion mounted to said second rail car unit, said articulation connection being capable of transferring a vertical shear load from said second portion to said first portion.

6. An articulated rail road car, said rail road car having releasable couplers at either end thereof for connection to other rail road cars, a longitudinal rolling direction, and wherein:

said articulated rail road car includes at least first and second rail car units carried on pivotally mounted rail car trucks, each said truck having spaced apart axles, said first and second rail car units being joined at an articulated connection through which vertical shear loads are passed between said first and second rail car units;

said first rail car unit has a first end proximate to said articulated connection, and a second end distant from said articulation connection;

said first rail car unit has a first of said rail car trucks pivotally mounted thereunder, said first rail car truck being closer to said articulation connection than any other of said rail car trucks;

said first rail car truck being located closer to said first end of said first rail car unit than to said second end of said first rail car unit; and said articulation connection is longitudinally eccentric relative to said first rail car truck.

7. The articulated rail road car of claim 6 wherein:

said second rail car unit has a first end proximate to said articulation connection, and a second end distant from said articulated connection;

said second rail car unit has a second of said rail car trucks mounted thereunder, said second rail car truck being located closer to said second end of said second rail car unit than to said first end of said second rail car unit; and said second rail car unit is free of rail car trucks between said articulation connection and said second rail car truck.

8. The articulated rail road car of claim 6 wherein:

said first rail car unit is supported by a second of said rail car trucks; and said second rail car truck is located closer to said second end of said first rail car unit than to said first end of said first rail car unit.

9. The articulated rail road car of claim 6 wherein:

said articulation connection is a first articulation connection;

said rail road car includes a third rail car unit joined to said second end of said first rail car unit at a second articulation connection;

a second of said rail car trucks is pivotally mounted under said second end of said first rail car unit;

said second rail car unit has a first end proximate to said first articulation connection, and a second end distant from said first articulated connection;

a third of said rail car trucks is mounted under said second end of said second rail car unit;

said third rail car unit has a first end proximate to said second articulation connection, and a second end distant from said second articulated connection; and a fourth of said rail car trucks is mounted under said second end of said third rail car unit.

10. The articulated rail road car of claim 9 wherein said rail road car is a three-pack articulated rail road car, said first rail car unit is a two truck middle car unit, and said second and third rail car units are single truck end units each having one of said releasable couplers mounted at the respective second ends thereof.

11. The articulated rail road car of claim 9 wherein:

said first rail car unit and said second rail car unit have mutually engaging side bearing arms mounted thereto; and said first rail car unit and said third rail car unit have mutually engaging side bearing arms mounted thereto.

12. The articulated rail road car of claim 9 wherein said second articulation connection is longitudinally eccentrically located relative to said second rail car truck.

13. The rail road car of claim 6 wherein:

said first rail car truck has a first pair of wheels mounted on a first axle, and a second pair of wheels mounted on a second axle;

said first axle being longitudinally outboard relative to said second axle; and said articulation connection being longitudinally outboard relative to said first axle.

14. The rail road car of claim 6 wherein said first car unit has side bearing arms extending from said first end thereof toward said second car unit; and said second car unit has side bearing arms extending therefrom to engage said side bearing arms of said first car unit.

15. The rail road car of claim 14 wherein said side bearing arms of said first car unit have bearing surfaces facing upward, and said side bearing arms of said second car unit have bearing surfaces facing downward.

16. The rail road car of claim 6 wherein:

said first car unit has a main bolster mounted over said first truck, and a center sill extending longitudinally outboard therefrom;

said center sill has a distal end longitudinally distant from said main bolster; and said articulation connection is mounted to said distal end of said center sill.

17. The rail road car of claim 16 wherein said center sill is a through center sill extending between said first and second ends of said first rail car unit.

18. The rail road car of claim 16 wherein said center sill is a stub center sill.

19. The rail road car of claim 18 wherein said first rail car unit has a well intermediate said first and second ends thereof.

20. The articulated rail road car of claim 6 wherein: said articulation connection is a first articulation connection; and said rail road car has a third rail car unit joined to said second rail car unit at a second articulation connection.

21. The articulated rail road car of claim 6 wherein said second articulation connection is mounted eccentrically relative to said second rail car truck.

22. The articulated rail road car of claim 6 wherein: said articulation connection is a first articulation connection; said rail road car has a third rail car unit joined to said second rail car unit at a second articulation connection; said third rail car unit has a first end proximate to said second articulated connection, and a second end distant from said second articulated connection; said third car unit has a second rail car truck mounted thereunder, said second rail car truck being located closer to said first end of said third rail car unit than to said second end of said third rail car unit; and said second articulated connection is longitudinally eccentric relative to said second rail car truck.

23. The articulated rail road car of claim 22 wherein said rail road car is free of trucks between said first articulation connection and said second articulation connection.

24. The articulated rail road car of claim 22 wherein said rail road car is free of trucks between said first and second trucks.

25. The articulated rail road car of claim 6 wherein: said first rail car unit has a main bolster mounted above said first truck, a center sill extending longitudinally outboard of said first truck toward said second rail car unit, and an endmost lateral structural member extending transversely relative to said center sill, said end bolster being located longitudinally outboard of said main bolster, and said center sill has a distal end outboard of said endmost lateral structural member to which said articulation connection is mounted.

26. The articulated rail road car of claim 25 wherein: said first car unit has longitudinally extending members located transversely outboard and to either side of said center sill; said longitudinally extending members run between said main bolster and said endmost lateral structural member, said longitudinally extending members extend longitudinally beyond said endmost lateral structural member to define a first pair of side bearing arms; and said second rail car unit has a second pair of side bearing arms mounted thereto, said second pair of side bearing arms being located to engage said first pair of side bearing arms.

27. The articulated rail road car of claim 25 wherein: said first rail car unit has longitudinally extending side sills connected to said main bolster and said endmost lateral structural member; said first car unit has longitudinally extending members each located intermediate said center sill and a respective one of said side sills; said longitudinally extending members run between said main bolster and said endmost lateral structural member, said longitudinally extending members extend longitudinally outboard beyond said endmost lateral structural member to define a first pair of side bearing arms; and said second rail car unit has a second pair of side bearing arms mounted thereto, said second pair of side bearing arms being located to engage said first pair of side bearing arms.

28. An articulated rail road car wherein:

said rail road car has first and second rail car units joined at an articulation connection;

said rail road car has a plurality of rail car trucks to permit said rail road car to proceed in a rolling direction along rail road tracks, said rolling direction defining a longitudinal direction;

said first rail car unit has a first end proximate said articulation connection and a second end distant from said articulation connection;

said first rail car unit is mounted upon a pair of said rail car trucks, said pair being first and second rail car trucks located under said first and second ends of said first rail car unit respectively, and being pivotable relative thereto about truck center axes;

said first and second rail road car trucks being separated by a truck center distance of at least 46 ft. 3 in.;

said articulation connection being closer to said first rail car truck than to any other rail car truck;

said first rail car unit has a pair of first and second bolsters located at either end thereof, said bolsters being mounted over said first and second rail car trucks respectively;

said first rail car unit has a center sill extending outboard of said first bolster toward said second rail car unit, said center sill having an outboard end; and said articulation connection is mounted to said outboard end of said center sill.

29. The articulated rail road car of claim 28 wherein:

said second rail car unit has a first end proximate said articulation connection and a second end distant from said articulation connection;

said second rail car unit is mounted upon a third rail car truck located under said second end of said second rail car unit; and said second rail car unit is free of trucks between said third rail car truck and said articulation connection.

30. The articulated rail road car of claim 29 wherein: said articulated connection is a first articulation connection; said rail road car has a third rail car unit connected to said second rail car unit at a second articulation connection; said second rail car unit has a main bolster mounted above said third rail car truck; said second rail car unit has a center sill extending outboard of said third rail car truck toward said third rail car unit, said center sill of said second rail car truck having a distal end distant from said third truck; and said second articulation connection is mounted to said distal end of said center sill of said second rail car unit.

31. The articulated rail road car of claim 29 wherein: said third rail car unit has a first end proximate said second articulation connection and a second end distant from said second articulation connection; said third rail car unit is mounted upon a fourth rail car truck located under said second end of said third rail car unit; and said third rail car unit is free of trucks between said fourth rail car truck and said second articulation connection.

32. The articulated rail road car of claim 28 wherein:

said articulation connection is a first articulation connection, said outboard end of said center sill is a first end thereof and said rail road car has a third rail car unit connected to said second end of said first rail car unit at a second articulation connection.

33. The articulated rail road car of claim 32 wherein:

said center sill is a through center sill having a second end located outboard of said second main bolster; and said second articulation connection is mounted to said second end of said center sill.

34. The articulated rail road car of claim 33 wherein:

said third rail car unit has a first end proximate said second articulation connection and a second end distant from said second articulation connection;

said third rail car unit is mounted upon a fourth rail car truck located under said second end of said third rail car unit; and said third rail car unit is free of trucks between said fourth rail car truck and said second articulation connection.

35. An articulated rail road car wherein, when standing on tangent track:

said rail road car has a first rail ear unit and a second rail car unit, said first and second rail car units being joined at an articulated connection;

each of said first and second rail car units has a proximal end near to said articulated connection, and a distal end lying away from said articulated connection;

the distal end of said first rail car unit is supported by a first rail car truck;

the distal end of said second rail car unit is supported by a second rail car truck;

a third rail car truck is pivotally mounted to said rail road car between said first and second trucks, said rail road car being free of trucks between said first and third trucks, and being free of trucks between said third truck and said second truck;

said third truck being spaced from said first truck a first distance, $D_1$;

said articulated connection being spaced from said first truck a second distance, $D_2$; and said first distance, $D_1$, being less than said second distance, $D_2$.

36. The articulated rail road car of claim 35 wherein:

said third truck is spaced from said second truck a third distance, $D_3$; and $D_3$ is different from $D_1$.

37. The articulated rail road car of claim 36 wherein $D_3$ is greater than $D_1$.

38. The articulated rail road car of claim 35 wherein:

said third truck is spaced from said articulated connection a third distance, $D_3$;

said second truck is spaced from said articulated connection a fourth distance, $D_4$; and $D_4$ is greater than $D_3$.

39. The articulated rail road car of claim 35 wherein said third rail car truck is pivotally mounted to said first rail car unit and said first distance, $D_1$, is at least 46 ft. - 3 in.

40. An articulated rail road freight car comprising a three pack rail road car having a two-truck middle unit and a pair of single truck end units, the middle unit being connected to at least one of the end units at a cantilevered articulation, and said two-truck middle unit having a pair of first and second spaced apart two axle trucks pivotally mounted thereto; and each said rail car unit has mutually engaging side bearing arms.

41. The articulated rail road freight car of claim 40 wherein each said rail road car is an auto-rack car.

42. The articulated rail road freight car of claim 41 further comprising bridge plates mounted to permit automobiles to be conducted from each said rail car unit to an adjacent rail car unit.

43. An articulated rail road road freight car comprising:

at least first and second rail car units connected at a cantilevered articulated connector through which vertical shear loads are passed between said first and second rail car units;

said rail road freight car having a first end, a second end, and a releasable coupler mounted at each of said first and second ends;

said releasable couplers being operable to permit interchangeable operation with other rail road freight cars in North American service;

said first railcar unit has a first end and a second end;

said second railcar unit has a first end and a second end;

said second end of said first railcar unit is joined to said first end of said second railcar unit at said articulated connector;

the second rail car unit is supported upon a pair of pivotally mounted, spaced apart, first and second two-axle railcar trucks, each of said trucks having a truck center;

said first truck of said second rail car unit is located closer to said first articulated connector than any other truck of said rail road car; and said first articulated connector is offset from said truck center of said first truck.

44. The articulated rail road freight car of claim 43 wherein said first railcar unit has a two-axle truck pivotally mounted thereunder, and said two axle truck of said first railcar unit is located closer to said first end of said first railcar unit than to said second end of said first railcar unit.

45. The articulated railroad freight car of claim 44 wherein a coupler is mounted at said first end of said first railcar unit.

46. The articulated rail road freight car of claim 43 wherein:

said railroad freight car includes a third railcar unit;

the third rail car unit has a first end and a second end;

the second end of the second rail car unit is joined to the first end of the third rail car unit at a second articulated connector;

said second truck of said second rail car unit is located closer to said second articulated connector than any other truck of said rail road car; and said second articulated connector is offset from said truck center of said second truck.

47. The articulated rail road freight car of claim 46 wherein said third railcar unit has a two-axle truck pivotally mounted thereunder, and said two axle truck of said third railcar unit is located closer to said second end of said third railcar unit than to said first end of said third railcar unit.

48. The articulated rail road freight car of claim 47 wherein a releasable coupler is mounted at said second end of said third railcar unit.

49. An articulated rail road freight car, wherein:

said rail road freight car has a first end, a second end, and a coupler mounted at each of said first and second ends, said couplers being operable to permit connection to other rail road cars;

said articulated rail road freight car is supported by a plurality of railcar trucks mounted to permit said rail road car to travel in a longitudinal direction along railroad tracks;

said rail road freight car includes at least first and second rail car units;

said first rail car unit has a first end and a second end;

said second rail car unit has a first end and a second end;

said second end of said first railcar unit is joined to said first end of said second railcar unit at a first articulated connector through which vertical shear leads are passed between said first and second railcar units;

said plurality of railcar trucks includes a pair of first and second spaced apart, two-axle railcar trucks pivotally mounted to said second railcar unit;

said first two-axle truck is mounted closer to said first articulated connector than is any other rail car truck of said articulated rail road freight car;

said first two-axle railcar truck has a truck center; and said truck center of said first two-axle truck is longitudinally offset from said first articulated connector.

50. The articulated rail road freight car of claim 49 wherein:

the first end of said first rail car unit is supported by a second rail car truck;

the second end of said second rail car unit is supported by a third rail car truck;

said rail road car is free of trucks between said first and second trucks, and is free of trucks between said first truck and said third truck;

said first truck is spaced from said second truck a first distance, $D_1$;

said articulation connection being spaced from said second truck a second distance, $D_2$; and said first distance, $D_1$, being less than said second distance, $D_2$.

51. The articulated rail road car of claim 50 wherein:

said third truck is spaced from said second truck a third distance, $D_3$; and $D_3$ is different from $D_1$.

52. The articulated rail road car of claim 51 wherein $D_3$ is greater than $D_1$.

53. The articulated rail road car of claim 50 wherein:

said third truck is spaced from said articulated connection a third distance, $D_3$;

said second truck is spaced from said articulated connection a fourth distance, $D_4$; and $D_4$ is greater than $D_3$.

54. The articulated rail road car of claim 50 wherein said third rail car truck is pivotally mounted to said first rail car unit and said first distance, $D_1$, is at least 46 ft. - 3 in.

55. The articulated rail road freight car of claim 49 wherein said first and second rail car units each have at least one deck upon which vehicles can be loaded.

56. The articulated rail road freight car of claim 55 further comprising bridge plates mounted to permit vehicles to be driven from said first rail car unit to said second rail car unit.

57. The articulated rail road freight car of claim 49 wherein said first and second rail car units have mutually engaging side bearing arms.

58. The articulated rail road freight car of claim 49 wherein said rail road car is an auto-rack car.

59. The articulated rail road freight car of claim 49 wherein at least one of said first and second rail car units is a well car unit.

60. An articulated rail road freight car, comprising:

at least a first rail car unit, a second railcar unit, and a third rail car unit;

said rail car units being supported by a plurality of railcar trucks for rolling motion along rail road tracks;

the first railcar unit having a first end and a second end;

the second railcar unit having a first end and a second end;

the third rail car unit having a first end and a second end;

the second end of the first rail car unit being joined to the first end of the second rail car unit at a first articulated connector;

the second end of the second rail car unit being joined to the first end of the third rail car unit at a second articulated connector;

the second rail car unit being supported upon a pair of pivotally mounted, spaced apart, first and second two axle railcar trucks, each of said trucks having a truck center;

said first truck of said second rail car unit being located closer to said first articulated connector than any other truck of said rail road car; and said first articulated connector being offset from said truck center of said first truck.

* * * * *

UNITED STATES PATENT AND TRADEMARK OFFICE

CERTIFICATE OF CORRECTION

PATENT NO. : 7,047,889 B2
APPLICATION NO. : 10/081120
DATED : May 23, 2006
INVENTOR(S) : James W. Forbes It is certified that error appears in the above-identified patent and that said Letters Patent is hereby corrected as shown below:

In claim 35, column 30, line 3, delete "ear" and insert --car--
In claim 43, column 30, line 55, delete first occurrence of the word --road--

Signed and Sealed this

Twelfth Day of December, 2006

JON W. DUDAS
*Director of the United States Patent and Trademark Office*